US012331446B2

(12) United States Patent
Ahn et al.

(10) Patent No.: US 12,331,446 B2
(45) Date of Patent: Jun. 17, 2025

(54) DRY APPARATUS AND CONTROLLING METHOD THEREOF

(71) Applicant: Samsung Electronics Co., Ltd., Suwon-si (KR)

(72) Inventors: Hyunjin Ahn, Suwon-si (KR); Changwan Kim, Suwon-si (KR); Haeyoon Park, Suwon-si (KR); Hyelim Park, Suwon-si (KR); Hyungwoo Lee, Suwon-si (KR); Taihyuk Jang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 663 days.

(21) Appl. No.: 17/574,029

(22) Filed: Jan. 12, 2022

(65) Prior Publication Data

US 2022/0170194 A1 Jun. 2, 2022

Related U.S. Application Data

(63) Continuation of application No. PCT/KR2021/016809, filed on Nov. 16, 2021.

(30) Foreign Application Priority Data

Dec. 1, 2020 (KR) ..... 10-2020-0166041
Jan. 29, 2021 (KR) ..... 10-2021-0013646

(51) Int. Cl.
*D06F 34/32* (2020.01)
*D06F 34/05* (2020.01)
(Continued)

(52) U.S. Cl.
CPC ..... *D06F 34/32* (2020.02); *D06F 34/05* (2020.02); *D06F 58/02* (2013.01); *D06F 58/38* (2020.02);
(Continued)

(58) Field of Classification Search
CPC ..... D06F 34/32; D06F 34/05; D06F 58/02; D06F 58/38; D06F 2103/06; D06F 2103/38; D06F 2105/60; D06F 34/18
(Continued)

(56) References Cited

U.S. PATENT DOCUMENTS 9,435,587 B2 9/2016 Lee et al.
9,602,170 B2 3/2017 Kamon et al.
(Continued)

FOREIGN PATENT DOCUMENTS

JP 2014030470 A 2/2014
JP 6098898 B2 3/2017
(Continued)

OTHER PUBLICATIONS

International Search Report and Written Opinion of the International Searching Authority in connection with International Application No. PCT/KR2021/016809 issued Mar. 4, 2022, 14 pages.

*Primary Examiner* — John P McCormack

(57) ABSTRACT

A displaying apparatus includes a communication interface, a display, a drum accommodating a subject to be dried, a sensing device that constructs a wireless communication link with the communication interface by using power generated through self-power generation according to a rotation of the drum, a hot air supplying device that supplies hot air to the drum, and a processor configured to, based on constructing the wireless communication link between the sensing device and the communication interface, display a first object on the display.

20 Claims, 23 Drawing Sheets

(51) Int. Cl.

| | |
|---|---|
| ***D06F 58/02*** | (2006.01) |
| ***D06F 58/38*** | (2020.01) |
| *D06F 103/06* | (2020.01) |
| *D06F 103/38* | (2020.01) |
| *D06F 105/60* | (2020.01) |

(52) U.S. Cl.
CPC ..... *D06F 2103/06* (2020.02); *D06F 2103/38* (2020.02); *D06F 2105/60* (2020.02)

(58) Field of Classification Search
USPC ..... 34/595
See application file for complete search history.

(56) References Cited

U.S. PATENT DOCUMENTS

| | | | | |
|---|---|---|---|---|
| 9,951,451 | B2 | 4/2018 | Park et al. | |
| 10,266,981 | B2 * | 4/2019 | Fulmer | D06M 13/395 |
| 10,633,778 | B2 | 4/2020 | Park et al. | |
| 10,808,351 | B1 * | 10/2020 | Flachsbart | G01K 13/00 |
| 11,479,896 | B2 | 10/2022 | Kim et al. | |
| 2013/0255101 | A1 | 10/2013 | Lee et al. | |
| 2014/0067131 | A1 | 3/2014 | Park et al. | |
| 2015/0044965 | A1 | 2/2015 | Kamon et al. | |
| 2017/0292725 | A1 * | 10/2017 | Conley | F24F 11/39 |
| 2018/0202093 | A1 | 7/2018 | Park et al. | |
| 2020/0248361 | A1 * | 8/2020 | Bae | D06F 33/32 |
| 2020/0263339 | A1 | 8/2020 | Kim et al. | |
| 2021/0102329 | A1 * | 4/2021 | Park | D06F 33/00 |

FOREIGN PATENT DOCUMENTS

| | | | | |
|---|---|---|---|---|
| JP | 2018143646 | A | | 9/2018 |
| JP | 6744070 | B2 | | 8/2020 |
| KR | 20040095017 | A | * | 11/2004 |
| KR | 10-2012-0079378 | A | | 7/2012 |
| KR | 10-2013-0111164 | A | | 10/2013 |
| KR | 10-2014-0032262 | A | | 3/2014 |
| KR | 10-1970251 | B1 | | 4/2019 |
| KR | 10-2020-0099831 | A | | 8/2020 |

* cited by examiner

DRY APPARATUS AND CONTROLLING METHOD THEREOF

CROSS-REFERENCE TO RELATED APPLICATIONS

This application is a bypass continuation of International Application No. PCT/KR2021/016809, filed on Nov. 16, 2021, which is based on and claims priority to Korean Patent Application No. 10-2020-0166041, filed on Dec. 1, 2020, and Korean Patent Application No. 10-2021-0013646, filed on Jan. 29, 2021, in the Korean Intellectual Property Office, the disclosures of which are incorporated by reference herein in their entireties.

BACKGROUND

1. Field

The disclosure relates to a dry apparatus and a controlling method thereof, and more particularly, to a dry apparatus that controls a dry process based on sensing data received from the outside, and a controlling method thereof.

2. Description of Related Art

In performing a dry process, a dry apparatus may include various sensor modules for figuring out the current state. Specifically, a dry apparatus may determine the weight or the dry temperature, etc. of a subject to be dried (or laundry) through sensor modules. Then, based on the weight or the dry temperature, etc. of the subject to be dried acquired through the sensor modules, the operation of the dry apparatus may be controlled.

Also, a dry degree inside a dry apparatus may be measured through a sensor module. The dry apparatus may determine whether the dry of a subject to be dried was completed based on the measured dry degree.

However, a sensor module is generally attached on the inside of a dry apparatus, and thus there is a problem that it is difficult to correctly analyze a subject to be dried inside the dry apparatus. In particular, a contact-type sensor module for determining a dry degree of a subject to be dried has a problem that its accuracy deteriorates in case the volume of a subject to be dried is big.

SUMMARY

The disclosure was devised for improving the aforementioned problem, and the purpose of the disclosure is in providing a dry apparatus that performs a dry process corresponding to a subject to be dried by using a self-powered sensing device, and provides an object relating to the sensing device to a user, and a controlling method thereof.

A dry apparatus according to an embodiment of the disclosure for achieving the aforementioned purpose includes a communication interface, a display, a drum accommodating a subject to be dried, a sensing device that constructs a wireless communication link with the communication interface by using power generated through self-power generation according to a rotation of the drum, a hot air supplying device that supplies hot air to the drum, and a processor configured to, based on constructing the wireless communication link between the sensing device and the communication interface, display a first object on the display.

Meanwhile, the first object may include at least one of an icon, a text, or an image for indicating that the sensing device has been connected.

Meanwhile, the processor may control the communication interface to receive sensing data from the sensing device, and while receiving the sensing data, control the display to display a second object for indicating that the subject to be dried is detected based on the sensing data.

Meanwhile, the processor may control a rotating operation of the drum, and based on receiving the sensing data during a first threshold time from the time when the drum started to rotate, control the display to display the second object during a second threshold time smaller than the first threshold time.

Meanwhile, the dry apparatus may further include a speaker, and the processor may output a predetermined alarm sound through the speaker at the time when the second object is displayed.

Meanwhile, the processor may detect the subject to be dried based on the sensing data acquired from the sensing device, and control the display to display a third object for indicating the detected subject to be dried.

Meanwhile, the processor may control the display to display a fourth object for indicating a dry course corresponding to the subject to be dried detected based on the sensing data acquired from the sensing device.

Meanwhile, the processor may determine an operation time of the hot air supplying device based on the sensing data acquired from the sensing device, and based on the hot air supplying device operating after the determined operation time, control the display to display a fifth object for indicating an additional operation of the hot air supplying device, and based on completing the operation of the hot air supplying device, control the display to display a sixth object for indicating that the operation of the hot air supplying device has been completed.

Meanwhile, the processor may determine an operation time of the hot air supplying device based on the sensing data acquired from the sensing device, and based on completing the operation of the hot air supplying device before the determined operation time, control the display to display a seventh object for indicating a difference between the determined operation time and the operation completion time of the hot air supplying device.

Meanwhile, the processor may, based on receiving a user input for inspecting the sensing device, control the display to display an eighth object for guiding a predetermined user action, acquire a change value of sensing data acquired from the sensing device that was acquired during a specific time from the time when the eight object was displayed, and based on the change value of the sensing data being smaller than a threshold value, control the display to display a ninth object for indicating a breakage of the sensing device, and based on the change value of the sensing data being greater than or equal to the threshold value, control the display to display a tenth object for indicating that the sensing device is normal.

A controlling method of a dry apparatus according to an embodiment of the disclosure includes the steps of receiving a signal for initiating an operation of the dry apparatus, and based on receiving the signal for initiating an operation, controlling a drum that is provided in the dry apparatus and accommodates a subject to be dried to rotate, and controlling a hot air supplying device provided in the dry apparatus to supply hot air to the drum, receiving identification information from a sensing device that performs self-power generation according to the rotation of the drum through a communication interface provided in the dry apparatus, and based on receiving the identification information, displaying a first object on a display provided in the dry apparatus.

Meanwhile, the first object may include at least one of an icon, a text, or an image for indicating that the sensing device has been connected.

Meanwhile, the controlling method may further include the steps of receiving sensing data from the sensing device, and while receiving the sensing data, displaying a second object for indicating that the subject to be dried is detected based on the sensing data.

Meanwhile, the controlling method may further include the step of controlling a rotating operation of the drum, and in the step of displaying the second object, based on receiving the sensing data during a first threshold time from the time when the drum started to rotate, the second object may be displayed during a second threshold time smaller than the first threshold time.

Meanwhile, the controlling method may further include the step of outputting a predetermined alarm sound through a speaker at the time when the second object is displayed.

Meanwhile, the controlling method may further include the steps of detecting the subject to be dried based on the sensing data acquired from the sensing device, and displaying a third object for indicating the detected subject to be dried.

Meanwhile, the controlling method may further include the step of displaying a fourth object for indicating a dry course corresponding to the subject to be dried detected based on the sensing data acquired from the sensing device.

Meanwhile, the controlling method may further include the steps of determining an operation time of the hot air supplying device based on the sensing data acquired from the sensing device, and based on the hot air supplying device operating after the determined operation time, displaying a fifth object for indicating an additional operation of the hot air supplying device, and based on completing the operation of the hot air supplying device, displaying a sixth object for indicating that the operation of the hot air supplying device has been completed.

Meanwhile, the controlling method may further include the steps of determining an operation time of the hot air supplying device based on the sensing data acquired from the sensing device, and based on completing the operation of the hot air supplying device before the determined operation time, displaying a seventh object for indicating a difference between the determined operation time and the operation completion time of the hot air supplying device.

Meanwhile, the controlling method may further include the steps of, based on receiving a user input for inspecting the sensing device, displaying an eighth object for guiding a predetermined user action, acquiring a change value of sensing data acquired from the sensing device that was acquired during a specific time from the time when the eight object was displayed, and based on the change value of the sensing data being smaller than a threshold value, displaying a ninth object for indicating a breakage of the sensing device, and based on the change value of the sensing data being greater than or equal to the threshold value, displaying a tenth object for indicating that the sensing device is normal.

Before undertaking the detailed description below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
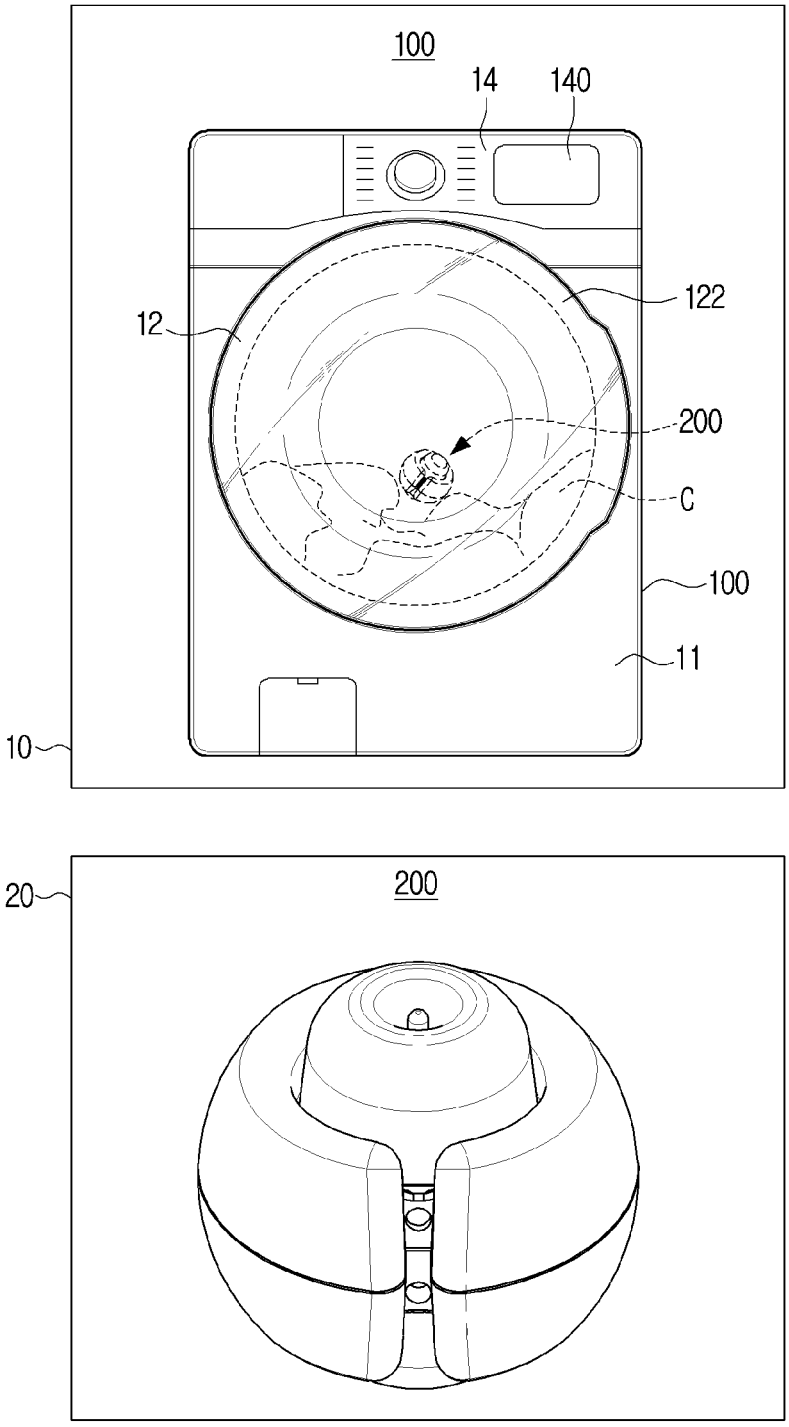
FIG. 1 is a diagram for illustrating a dry apparatus and a sensing device.

FIGS. 1 through 23, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter, the disclosure will be described in detail with reference to the accompanying drawings.

As terms used in the embodiments of the disclosure, general terms that are currently used widely were selected as far as possible, in consideration of the functions described in the disclosure. However, the terms may vary depending on the intention of those skilled in the art who work in the pertinent technical field or previous court decisions, emergence of new technologies, etc. Also, in particular cases, there may be terms that were arbitrarily designated by the applicant, and in such cases, the meaning of the terms will be described in detail in the relevant descriptions in the disclosure. Accordingly, the terms used in the disclosure should be defined based on the meaning of the terms and the overall content of the disclosure, but not just based on the names of the terms.

Also, in this specification, expressions such as "have," "may have," "include," and "may include" denote the existence of such characteristics (e.g.: elements such as numbers, functions, operations, and components), and do not exclude the existence of additional characteristics.

In addition, the expression "at least one of A and/or B" should be interpreted to mean any one of "A" or "B" or "A and B."

Further, the expressions "first," "second" and the like used in this specification may be used to describe various elements regardless of any order and/or degree of importance. Also, such expressions are used only to distinguish one element from another element, and are not intended to limit the elements.

Also, the description in the disclosure that one element (e.g.: a first element) is "(operatively or communicatively) coupled with/to" or "connected to" another element (e.g.: a second element) should be interpreted to include both the case where the one element is directly coupled to the another element, and the case where the one element is coupled to the another element through still another element (e.g.: a third element).

Meanwhile, singular expressions include plural expressions, as long as they do not obviously mean differently in the context. In addition, in the disclosure, terms such as "include" and "consist of" should be construed as designating that there are such characteristics, numbers, steps, operations, elements, components, or a combination thereof described in the specification, but not as excluding in advance the existence or possibility of adding one or more of other characteristics, numbers, steps, operations, elements, components, or a combination thereof.

Further, in the disclosure, "a module" or "a part" performs at least one function or operation, and may be implemented as hardware or software, or as a combination of hardware and software. Also, a plurality of "modules" or "parts" may be integrated into at least one module and implemented as at least one processor (not shown), except "modules" or "parts" which need to be implemented as specific hardware.

Also, in this specification, the term "user" may refer to a person who uses an electronic apparatus or an apparatus using an electronic apparatus (e.g.: an artificial intelligence electronic apparatus).

Hereinafter, an embodiment of the disclosure will be described in more detail with reference to the accompanying drawings.

FIG. 1 is a diagram for illustrating a dry apparatus and a sensing device.

Referring to an embodiment (10) of FIG. 1, a dry apparatus 100 may include a cabinet 11, a door 12, a drum 122, a manipulation panel 14, and a display 140.

The dry apparatus 100 may be an apparatus that dries a subject to be dried (or laundry or wet laundry or target object for drying)C for which washing was completed. The subject to be dried C may be clothing, bedding, a towel, etc., but is not limited thereto. Here, the subject to be dried C may also be expressed as a subject to be dried.

The dry apparatus 100 may include an air circulating device that circulates the air of the drum 122, and a hot air supplying device that heats air of a middle temperature and high humidity discharged from the drum 122 and makes it air of a high temperature and low humidity. For example, the subject to be dried C which is damp as washing was completed may be dried inside the drum 122 of the dry apparatus 100 according to the operations of the air circulating device and the hot air supplying device.

For effectively drying a subject to be dried, the drum 122 may be formed to continuously rotate such that air of a high temperature and low humidity may homogeneously contact the subject to be dried.

On the front surface of the cabinet 11, an inlet through which the subject to be dried C can be taken in or taken out may be provided. The door 12 may be hinge-coupled to the front surface of the cabinet 11, and open or close the inlet of the cabinet 11.

In the upper part of the front surface of the cabinet 11, a manipulation panel 14 that can control the dry apparatus 100 may be provided. The manipulation panel 14 may include a display 140 that can display the state of the dry apparatus 100. A user may operate the dry apparatus 100 by manipulating the manipulation panel 14. Here, the manipulation panel 14 may correspond to a user interface 105. Here, the manipulation panel 14 may be implemented as a circular dial, or implemented as a touch panel.

The drum 122 may be installed to be rotatable inside the cabinet 11, and one end of the drum 122 may be installed to be in communication with the inlet of the cabinet 11.

Referring to an embodiment (20) of FIG. 1, a sensing device 200 may be introduced into the inside of the drum 122 through the inlet of the dry apparatus 100.

The sensing device 200 may be a device that is introduced into the inside of the dry apparatus 100 and is movable. Here, the sensing device 200 may include an energy harvester, a sensor part, a communication interface, and a case. Here, the sensing device 200 may also be described as a sensor ball.

The energy harvester is formed to convert a movement of the sensing device 200 into electricity. In other words, the energy harvester may generate power by using a movement of the sensing device 200.

For example, in a state wherein the sensing device 200 is put inside the drum 122 of the dry apparatus 100, if the dry apparatus 100 is operated, the drum 122 rotates. When the drum rotates 122, the sensing device 200 introduced into the inside of the drum 122 performs a free fall movement. That is, according to the rotation of the drum 122, the sensing device 200 falls from the upper part of the inner space of the drum 122 to the lower part. Then, the energy harvester may convert the movement of the sensing device 200, i.e., the free fall movement into electricity. In other words, it may be said that the energy harvester of the sensing device 200 converts a rotating movement of the drum 122 into electricity. For this, the energy harvester may generate power by using a permanent magnet and a coil.

The energy harvester may include a cylinder, a coil, and a permanent magnet. When the sensing device 200 introduced into the drum 122 is moved by the drum 122, the energy harvester may generate power. That is, the energy harvester of the sensing device 200 may convert a rotation of the drum 122 of the dry apparatus 100 into electricity.

The sensor part may include at least one of a movement amount measurement sensor for sensing a movement amount of the sensing device 200, a harvester voltage sensor for sensing a harvester voltage of the energy harvester, a contact-type electrode sensor for sensing the dry degree of the surface contacting the sensing device 200, a temperature sensor, or a humidity sensor.

Here, the harvester voltage sensor may measure a voltage measured based on a movement amount of the sensing device 200. For example, as a movement amount of the sensing device 200 is greater, a harvester voltage may be measured to be higher.

Here, the contact-type voltage sensor may mean an electrode sensor for identifying the dry degree of the surface of the sensing device 200. The contact-type voltage sensor may sense how much humidity a subject to be dried has while contacting the subject to be dried. In case a subject to be dried has a lot of moisture, a voltage acquired from the contact-type voltage sensor may be measured to be low. In case a subject to be dried has no moisture or the contact-type voltage sensor does not contact a subject to be dried, a voltage acquired from the contact-type voltage sensor may be measured to be high.

The sensor part may acquire at least one of a movement amount, a harvester voltage, a moving pattern, a dry degree, a temperature, or humidity of the sensing device 200. Here, the sensor part may include at least one of a distance sensor that can measure a movement amount of the sensing device, a harvester voltage measurement sensor according to a movement, a moving pattern analysis module, a contact-type electrode sensor that can measure a dry degree, a temperature sensor, or a humidity sensor. Depending on implementation examples, the sensor part may perform only measurement of a movement amount, and analysis of a moving pattern may be performed at the dry apparatus 100.

Here, the communication interface may transmit sensing data acquired at the sensor part to the dry apparatus 100. Here, the communication interface may include a wireless communication module, and the wireless communication module may be a communication module using one of Bluetooth, Wi-Fi, Zigbee, or Z-wave.

Here, the case may be a member enclosing the energy harvester, the sensor part, and the communication interface, and it may include a member for which waterproofing was performed.

Figure 2:
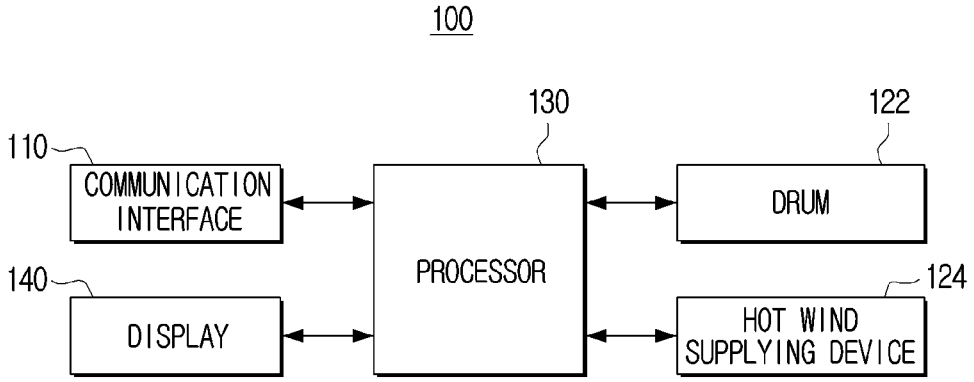
FIG. 2 is a block diagram illustrating a dry apparatus according to an embodiment of the disclosure.

FIG. 2 is a block diagram illustrating a dry apparatus according to an embodiment of the disclosure.

Referring to FIG. 2, the dry apparatus 100 may include a user interface 105, a communication interface 110, a drum 122, a hot air supplying device 124, a display 140, and a processor 130.

The user interface 105 may be implemented as a device such as a button, a touch pad, a mouse, and a keyboard, or it may also be implemented as a touch screen that can perform the aforementioned display function and a manipulation input function together. Here, the button may be various types of buttons such as a mechanical button, a touch pad, a wheel, etc. formed in any areas such as the front surface part or the side surface part, the rear surface part, etc. of the exterior of the main body of the dry apparatus 100.

The user interface 105 may receive input of a dry course from a user.

The communication interface 110 is a component that performs communication with various types of external apparatuses according to various types of communication methods. The communication interface 110 includes a Wi-Fi module, a Bluetooth module, an infrared communication module, and a wireless communication module, etc. Here, each communication module may be implemented in a form of at least one hardware chip.

A Wi-Fi module and a Bluetooth module perform communication by a Wi-Fi method and a Bluetooth method, respectively. In the case of using a Wi-Fi module or a Bluetooth module, various kinds of connection information such as an SSID and a session key, etc. are transmitted and received first, and communication is connected by using them, and then various kinds of information may be transmitted and received.

An infrared communication module performs communication according to an infrared Data Association (IrDA) technology of transmitting data to a near field wirelessly by using infrared rays between visible rays and millimeter waves.

A wireless communication module may include at least one communication chip performing communication according to various wireless communication protocols such as Zigbee, 3rd Generation (3G), 3rd Generation Partnership Project (3GPP), Long Term Evolution (LTE), LTE Advanced (LTE-A), 4th Generation (4G), 5th Generation (5G), etc. other than the aforementioned communication methods.

Other than the above, the communication interface 110 may include at least one of a Local Area Network (LAN) module, an Ethernet module, or a wired communication module performing communication by using a pair cable, a coaxial cable, an optical fiber cable, or an Ultra Wide-Band (UWB) module, etc.

According to an embodiment, the communication interface 110 may use the same communication module (e.g., a Wi-Fi module) for communicating with an external apparatus such as a remote control and an external server.

According to another embodiment, the communication interface 110 may use different communication modules (e.g., a Wi-Fi module) for communicating with an external apparatus such as a remote control and an external server. For example, the communication interface 110 may use at least one of an Ethernet module or a Wi-Fi module for communicating with an external server, and may use a BT module for communicating with an external apparatus such as a remote control. However, this is merely an embodiment, and the communication interface 110 may use at least one communication module among various communication modules in the case of communicating with a plurality of external apparatuses or external servers.

The drum 122 may mean a dry tub accommodating a subject to be dried.

The hot air supplying device 124 may supply a heat source to the drum 122.

The display 140 may display various objects. Here, an object may mean a graphic user interface (GUI).

The processor 130 may perform overall controlling operations of the dry apparatus 100. Specifically, the processor 130 performs a function of controlling the overall operations of the dry apparatus 100.

The processor 130 may be implemented as a digital signal processor (DSP) processing digital signals, a microprocessor, and a time controller (TCON). However, the disclosure is not limited thereto, and the processor 130 may include one or more of a central processing unit (CPU), a micro controller unit (MCU), a micro processing unit (MPU), a controller, an application processor (AP), a graphics-processing unit (GPU) or a communication processor (CP), and an ARM processor, or may be defined by the terms. Also, the processor 130 may be implemented as a System on Chip (SoC) having a processing algorithm stored therein or large scale integration (LSI), or in the form of a field programmable gate array (FPGA). Further, the processor 130 may perform various functions by executing computer executable instructions stored in the memory.

Here, the dry apparatus 100 may be connected with the sensing device 200 that constructs (or establishes) a wireless communication link with the communication interface 110 by using power generated through self-power generation according to a rotation. Also, the dry apparatus 100 may include a hot air supplying device 124 that supplies hot air to the drum 122. In addition, in response to the construction of a wireless communication link between the sensing device 200 and the communication interface 110, the processor 130 may display a first object on the display 140.

Here, the processor 130 may identify whether a wireless communication link with the sensing device 200 is constructed through the communication interface 110. If a wireless communication link with the sensing device 200 is constructed, the processor 130 may display the first object on the display 140.

Meanwhile, the processor 130 may control the operation of the hot air supplying device 124 based on the dry course input through the user interface 105, and the processor 130 may determine the operation time of the hot air supplying device 124 based on sensing data.

Here, the sensing data may be data acquired from the sensing device 200. The sensing device 200 may transmit sensing data corresponding to a self-power generated voltage to the dry apparatus 100. The dry apparatus 100 may receive the sensing data of the sensing device 200 through the communication interface 110. Here, the self-power generation of the sensing device 200 may be a rotation movement or a drop movement by the drum 122 of the dry apparatus 100. Here, the sensing device 200 may obtain (or harvest) power from rotating in the drum 122.

Meanwhile, the sensing data may include at least one of a movement amount, humidity, or a temperature.

Meanwhile, the sensing device 200 may move together with a subject to be dried accommodated in the drum 122 by a rotation of the drum 122, and may be connected with the communication interface 110 through wireless communication. The sensing device 200 may transmit the sensing data to the dry apparatus 100 by using a wireless communication method. Also, the dry apparatus 100 may transmit information to the sensing device 200 by using a wireless communication method.

The dry apparatus 100 may include a processor 130 that controls the operation of the hot air supplying device 124 based on the dry course input through the user interface 105, and the processor 130 may perform self-power generation according to a rotation of the drum 122. Also, if the sensing device 200 transmitting sensing data corresponding to a generated voltage to the communication interface 110 is connected to the communication interface 110, the processor 130 may control the display 140 to display the first object for indicating that the sensing device 200 has been connected.

Here, a user may select one dry course among a plurality of dry courses, and the processor 130 may perform a dry process based on the received input of the dry course by the user. An operation of performing a dry process may mean operating the hot air supplying device 124 supplying hot air to the drum 122. Specifically, the processor 130 may determine setting information of a dry process for operating the hot air supplying device 124. Here, the setting information may include at least one of a dry time, a dry temperature, the strength of the hot air, or the rotating speed of the drum. The details of the setting information may vary for each of the plurality of dry courses.

Here, the sensing device 200 may be a device that performs self-power generation according to a rotation of the drum 122. Also, the sensing device 200 may acquire sensing data inside the drum 122. The sensing device 200 may not be a component of the dry apparatus 100, but it may be an independent device.

Here, the sensing data may be data acquired from the sensing device 200. The sensing device 200 may transmit sensing data corresponding to a self-power generated voltage to the dry apparatus 100. The dry apparatus 100 may receive the sensing data of the sensing device 200 through the communication interface 110. Here, the self-power generation of the sensing device 200 may be a rotation movement or a drop movement by the drum 122 of the dry apparatus 100.

Here, the sensing data may include at least one of humidity or a temperature.

Here, the sensing device 200 may move together with a subject to be dried accommodated in the drum 122 by a rotation of the drum 122, and may be connected with the communication interface 110 through wireless communication. The sensing device 200 may transmit the sensing data to the dry apparatus 100 by using a wireless communication method. Also, the dry apparatus 100 may transmit information to the sensing device 200 by using a wireless communication method.

Here, the sensing data may include a voltage corresponding to self-power generation of the sensing device 200. Also, humidity or a temperature may be determined based on a voltage value. For this, a lookup table wherein a voltage and humidity or a temperature are matched may be stored in the dry apparatus 100 or the sensing device 200.

Here, if a user input that selected a dry course is received, the processor 130 may identify whether the sensing device 200 is connected to the dry apparatus 100. Then, if it is identified that the sensing device 200 is connected to the dry apparatus 100, the processor 130 may display a first object for indicating that the sensing device 200 is connected to the dry apparatus 100. Here, the first object may be the object 1122 in FIG. 11. When the first object is displayed on the display 140, the user may easily identify that the sensing device 200 is in a state of being connected normally.

Meanwhile, the first object may include at least one of an icon, a text, or an image for indicating that the sensing device 200 has been connected.

For example, the first object may include at least one of an icon in the shape of the sensing device 200, a text which is 'sensor ball', or an image in the shape of the sensing device 200.

Meanwhile, the processor 130 may control the communication interface 110 to receive sensing data from the sensing device 200, and control the display 140 to display a second object for indicating that a subject to be dried is detected (or identified or analyzed) based on receiving the sensing data while the sensing data.

Here, the second object may be an object for indicating that a subject to be dried inside the drum 122 is currently detected through the sensing device 200. For example, the second object may be the object 1123 in FIG. 11.

Here, the processor 130 may receive sensing data from the sensing device 200 that performs self-power generation according to a rotation of the drum 122. Here, the sensing data may be data corresponding to a self-power generated voltage. If the drum 122 rotates, the sensing device 200 located inside the drum 122 may also rotate. Then, the sensing device 200 may acquire a voltage (or a harvester voltage) based on a drop movement by the rotation. Here, the harvester voltage may mean a voltage acquired based on movement energy or location energy. For example, as the sensing device 200 moves more, a higher harvester voltage value may be acquired.

Here, if a user input that selected a dry course is received, the processor 130 may rotate the drum 122 based on a dry course corresponding to the user input. Then, the processor 130 may detect whether the sensing device 200 exists inside the drum 122. Then, if the sensing device 200 is detected, the processor 130 may detect a subject to be dried.

Here, if a user input that selected a dry course is received, and it is identified that the dry apparatus 100 is connected with the sensing device 200 inside the drum 122, the processor 130 may detect (or identify or analyze) the subject to be dried inside the drum 122. Here, the meaning of detecting may not only mean recognizing whether a subject to be dried exists, but also mean acquiring various kinds of information (characteristic information of the subject to be dried) related to the subject to be dried.

Here, the processor 130 may receive sensing data during a predetermined time from the sensing device 200 for detecting a subject to be dried. Specifically, the processor 130 may acquire sensing data corresponding to a self-power generated voltage from the sensing device 200 during a predetermined time (e.g., ten minutes). Then, the processor 130 may detect a subject to be dried based on the acquired sensing data.

Here, the processor 130 may display a second object for indicating that a subject to be dried is detected while detecting the subject to be dried.

According to an embodiment, the processor 130 may display the second object during the entire time of detecting a subject to be dried. For example, if the predetermined time is ten minutes, the processor 130 may display the second object for ten minutes.

According to another embodiment, the processor 130 may display the second object during a partial time of detecting a subject to be dried.

Specifically, the processor 130 may control a rotating operation of the drum 122, and if sensing data is received during a first threshold time from the time of the drum 122 starting to rotate, the processor 130 may control the display 140 to display the second object during a second threshold time smaller than the first threshold time.

Here, the first threshold time may mean a time (e.g., ten minutes) determined in advance for detecting a subject to be dried. Specifically, the processor 130 may display the second object during the second threshold time (e.g., nine minutes) faster than the first threshold time (e.g., ten minutes) from the time of the drum 122 starting to rotate. Ultimately, the second object may be displayed on the display 140 as much as a difference value (e.g., one minute) of the first threshold time and the second threshold time.

Meanwhile, the dry apparatus 100 may further include a speaker 160, and the processor 130 may output a predetermined alarm sound through the speaker 160 at the time when the second object is displayed.

Here, the processor 130 may output a predetermined alarm sound through the speaker 160 at the same time as displaying the second object for indicating that the second object is displayed. Here, the predetermined alarm sound may be melody or a simple beep sound. Depending on implementation examples, the speaker 160 may include at least one of a module that can output various sounds or a beeper module outputting only a beep sound.

Here, the processor 130 may output a predetermined alarm sound whenever an object displayed on the display 140 is changed.

Meanwhile, the processor 130 may detect (or identify or analyze) a subject to be dried based on sensing data, and control the display 140 to display a third object for indicating the detected subject to be dried.

Here, the processor 130 may detect a subject to be dried based on sensing data acquired during a predetermined period. Specifically, the processor 130 may acquire characteristic information of the subject to be dried based on the sensing data received during the predetermined period. Here, the characteristic information of the subject to be dried may include at least one of the type information of the subject to be dried, the volume information of the subject to be dried, the material information of the subject to be dried, the shape information of the subject to be dried, or the weight information of the subject to be dried.

Here, if the type information of the subject to be dried is detected, the processor 130 may display a third object including the type information of the subject to be dried. Here, the third object may be the object 1124 in FIG. 11.

Meanwhile, the processor 130 may control the display 140 to display a fourth object for indicating a dry course corresponding to the subject to be dried that was detected (or identified or analyzed) based on the sensing data.

Here, the processor 130 may acquire characteristic information of the subject to be dried, and identify a dry course corresponding to the subject to be dried based on the acquired characteristic information of the subject to be dried. Here, the dry course corresponding to the subject to be dried may mean a dry course appropriate for the subject to be dried. Also, the processor 130 may acquire setting information of a dry process corresponding to the subject to be dried. For example, if the subject to be dried is identified as bedding, the processor 130 may identify a dry course appropriate for dry of bedding, or acquire setting information of a dry process appropriate for dry of bedding.

Here, the processor 130 may display the fourth object including the identified dry course. Here, the fourth object may be the object 1211 in FIG. 12. For example, it is assumed that the subject to be dried is identified as bedding, and a dry course appropriate for bedding is 'blanket-customized dry.' The processor 130 may display 'blanket-customized dry' on the display 140.

Also, the processor 130 may determine the operation time of the identified dry course. For example, if the dry course is identified as blanket-customized dry, the processor 130 may identify that the operation time of the dry course is 60 minutes.

Here, after determining the operation time of the dry course, the processor 130 may perform a dry process based on the determined dry course. Also, the sensing device 200 may continuously acquire sensing data during the dry process. This is for identifying the dry degree of the subject to be dried during the dry process. Accordingly, the processor 130 may acquire sensing data from the sensing device 200 even during the dry process. Then, the processor 130 may change the setting information of the dry process based on the acquired sensing data.

For example, while the dry process is performed based on the sensing data, the setting information of the dry process may be changed. As the setting information of the dry process is changed, the operation time of the dry process may be shortened or extended.

There may be various embodiments wherein setting information of a dry process is changed.

As steps wherein setting information of a dry process is determined or changed, there may be a step wherein a user inputs a general dry course, a step wherein the sensing device 200 detects a subject to be dried and identifies a dry course, and a step wherein setting information of a dry process is acquired based on sensing data acquired while the dry process is performed.

First, if a user input that selects a dry course is received, the processor 130 may determine first setting information corresponding to the dry course input by the user. Then, the processor 130 may perform a dry process based on the determined first setting information.

Secondly, while the dry process is performed based on the first setting information, the processor 130 may detect a subject to be dried based on first sensing data acquired during a first threshold time, and identify a dry course corresponding to the detected subject to be dried. Then, the processor 130 may determine second setting information corresponding to the identified dry course. Then, the processor 130 may perform a dry process based on the determined second setting information. Here, in case the first setting information and the second setting information are different, the processor 130 may perform the dry process based on the second setting information.

Thirdly, while the dry process is performed based on the second setting information, the processor 130 may acquire second sensing data from the sensing device 200. Then, the processor 130 may determine third setting information based on the acquired second sensing data. Then, the processor 130 may perform a dry process based on the determined third setting information. Here, in case the second setting information and the third setting information are different, the processor 130 may perform the dry process based on the third setting information.

Here, the types of the first sensing data and the second sensing data may be different. Specifically, the first sensing data may be a harvester voltage, and the second sensing data may be humidity data.

In the setting information, a dry time may be included, and the processor 130 may acquire a first dry time included in the first setting information, a second dry time included in the second setting information, and a third dry time included in the third setting information. Here, the first dry time, the second dry time, and the third dry time may mean the remaining operation times of the dry process.

For example, it is assumed that the first dry time corresponding to a dry course selected by a user is 50 minutes. Here, the remaining time may be 50 minutes. Then, it is assumed that the processor 130 detected a subject to be dried based on the first sensing data acquired for 10 minutes. At the time when 10 minutes passed, the remaining time may be 40 minutes. At the time when the remaining time is 40 minutes, the processor 130 may acquire a second dry time corresponding to the subject to be dried detected based on the sensing data. Here, the second dry time may be 50 minutes. Here, the second dry time may be 50 minutes as the remaining time of 10 minutes was added. Here, if it is assumed that the dry process proceeded for 50 minutes, the remaining time may be 0 minute. Here, it may be assumed that the processor 130 acquired a third dry time based on the second sensing data, and the third dry time is 10 minutes. Here, the third dry time may be 10 minutes as the remaining time of 10 minutes was added. Detailed explanation in this regard will be additionally made in FIG. 11 and FIG. 12.

In the aforementioned embodiment, a total operation time of 20 minutes was added. Ultimately, the first dry time was 50 minutes, but the total operation time was 70 minutes. Accordingly, the processor 130 may perform the dry process for 20 minutes more than the determined first dry time.

In the aforementioned embodiment, it was described that an additional operation time was added, but in contrast, the operation time may be reduced.

In the aforementioned embodiment, it was described that a difference between the times of acquiring the first dry time and the second dry time is 10 minutes. However, according to another embodiment, the difference between the times of acquiring the first dry time and the second dry time may be determined as within several minutes. That is, the time of detecting a subject to be dried may be determined as a smaller time. Here, the first dry time may not have meaning. This is because a user determines that the second dry time related to the most appropriate dry course is important by using the sensing device 200. Accordingly, the processor 130 may omit the first dry time, and determine whether to perform an additional operation based on the second dry time. Specifically, if the remaining time increases at the time of acquiring the third dry time, the processor 130 may identify that an additional operation of the dry process is necessary. Also, if the remaining time decreases at the time of acquiring the third dry time, the processor 130 may identify that the total operation time of the dry process is shortened.

Meanwhile, the processor 130 may determine the operation time (the first dry time or the second dry time) of the hot air supplying device 124 based on sensing data, and if the hot air supplying device 124 is operated after the determined operation time (the first dry time or the second dry time), the processor 130 may control the display 140 to display a fifth object for indicating an additional operation of the hot air supplying device 124. Then, when the operation of the hot air supplying device 124 is completed, the processor 130 may control the display 140 to display a sixth object for indicating that the operation of the hot air supplying device 124 was completed.

Here, if it is identified that the dry process should be performed longer than the operation time that was initially determined, the processor 130 may display the fifth object at the time when the initially determined operation time passed.

Figure 12:
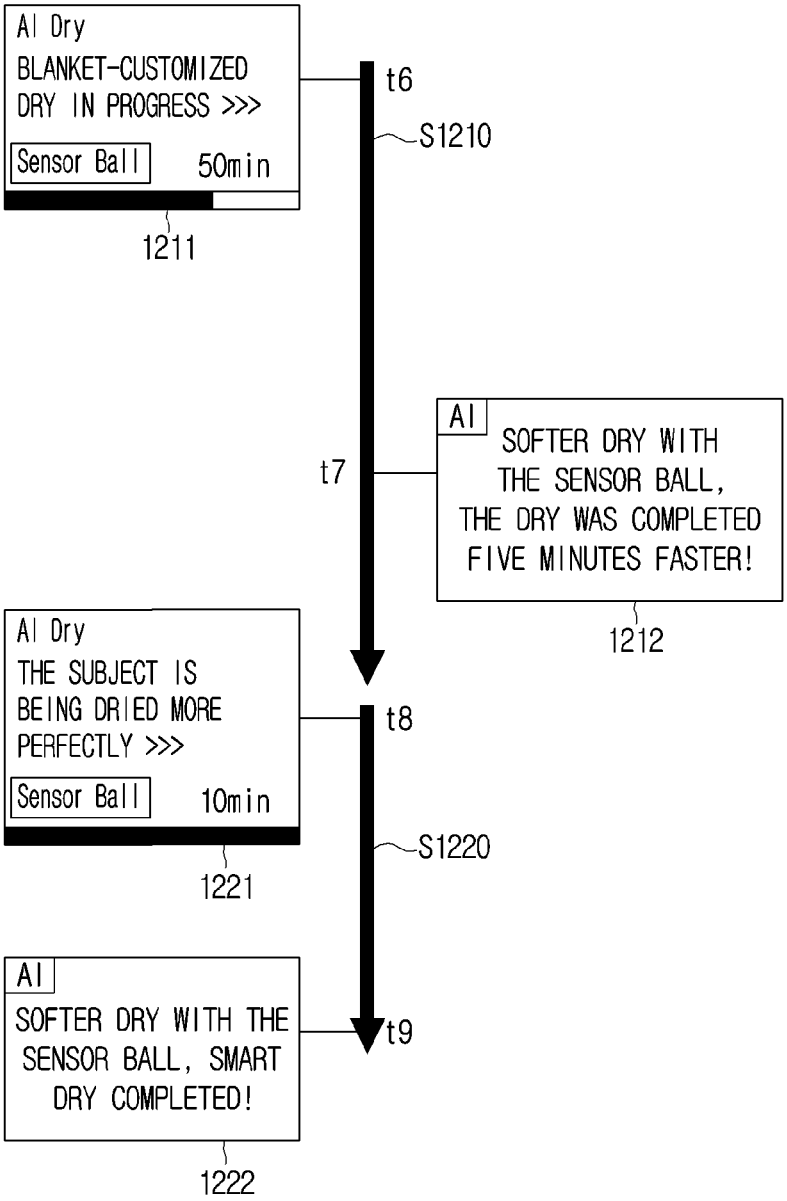
FIG. 12 is a diagram for illustrating an object displayed according to another embodiment.

Here, the fifth object may be the object 1221 in FIG. 12, and the sixth object may be the object 1222 in FIG. 12.

Meanwhile, the processor 130 may determine the operation time (the first dry time or the second dry time) of the hot air supplying device 124 based on sensing data, and if the operation of the hot air supplying device 124 is completed before the determined operation time (the first dry time or the second dry time), the processor 130 may control the display 140 to display a seventh object for indicating the difference in the operation completion time.

If the dry process is completed prior to the determined operation time, the processor 130 may identify how fast the dry process was completed. Specifically, the processor 130 may acquire a difference value between the determined operation time and the actual operation time, and display the seventh object including the acquired difference value. Here, the seventh object may be the object 1212 in FIG. 12.

For example, if the determined operation time is 50 minutes, and the actual operation time is 45 minutes, the processor 130 may determine that the dry process was completed five minutes earlier. Then, the processor 130 may display the seventh object indicating that the dry process was completed five minutes earlier.

Figure 9:
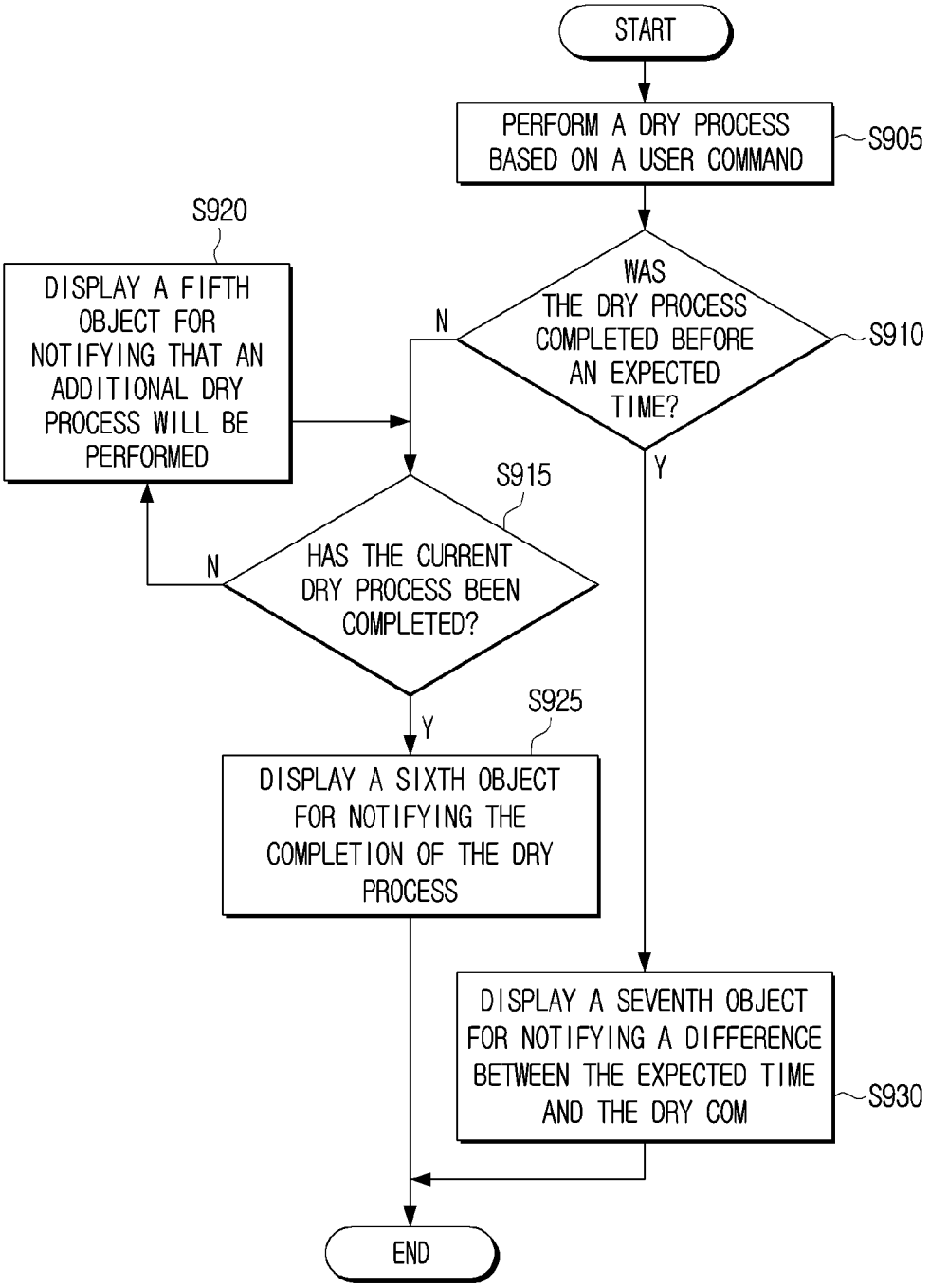
FIG. 9 is a flow chart for illustrating an operation of displaying an object according to another embodiment.

Here, the operation related to the dry process will be additionally described in FIG. 9.

Meanwhile, if a user input for inspecting the sensing device 200 is received through the user interface 105, the processor 130 may control the display 140 to display an eighth object for guiding a predetermined user action, and acquire a change value of the sensing data acquired during a specific time from the time when the eight object was displayed. Then, if the change value of the sensing data is smaller than a threshold value, the processor 130 may control the display 140 to display a ninth object for indicating the breakage of the sensing device 200, and if the change value of the sensing data is greater than or equal to the threshold value, the processor 130 may control the display 140 to display a tenth object for indicating that the sensing device 200 is normal.

Here, if a user input for inspecting the sensing device 200 is received, the processor 130 may perform a test mode corresponding to the sensing device 200. Depending on implementation examples, the test mode corresponding to the sensing device 200 may be automatically performed when the sensing device 200 is initially connected to the dry apparatus 100.

The test mode may mean a mode wherein it is determined whether functions regarding various sensors sensed at the sensing device 200 are normal.

Here, a predetermined user action according to an embodiment may be an operation of shaking the sensing device 200. Meanwhile, a predetermined user action according to another embodiment may be an operation of blowing wind to the sensing device 200.

Here, a change value of the sensing data according to an embodiment may be a change value of the movement amount information. Meanwhile, a change value of the sensing data according to another embodiment may be a change value of the humidity information.

According to an embodiment, the processor 130 may test a function of acquiring the movement amount information of the sensing device 200. For determining whether the movement amount information is acquired normally, the processor 130 may display an object for guiding to shake the sensing device 200. If a user shakes the sensing device 200, the sensing device 200 may acquire the movement amount information. Based on the acquired movement amount information, the processor 130 may determine that the function of acquiring the movement amount information of the sensing device 200 is normal.

According to another embodiment, the processor 130 may test a function of acquiring the humidity information of the sensing device 200. For determining whether the humidity information is acquired normally, the processor 130 may display an object for guiding to blow wind to the sensing device 200. If a user blows wind to the sensing device 200, the sensing device 200 may acquire the humidity information, and transmit the information to the dry apparatus 100. Based on the acquired change value of the humidity, the processor 130 may determine whether the function of acquiring the humidity information of the sensing device 200 is normal. Specifically, if the change value of the humidity is greater than or equal to a threshold value, the processor 130 may determine whether the function of acquiring the humidity information of the sensing device 200 is normal.

Here, detailed explanation related to the inspecting operation of the sensing device 200 will be made below in FIG. 10 and FIG. 14.

Figure 14:
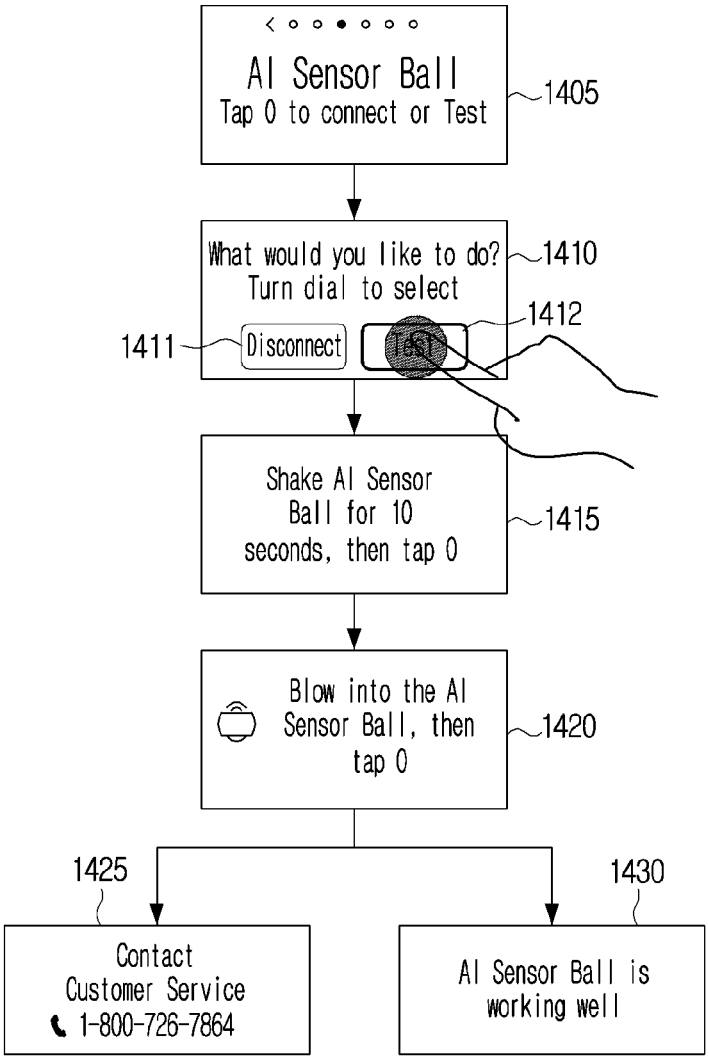
FIG. 14 is a diagram for illustrating an object displayed in an operation of testing a sensing device.

Here, the eighth object may be the object 1415 or the object 1420 in FIG. 14, and the ninth object may be the object 1425 in FIG. 14, and the tenth object may be the object 1430 in FIG. 14.

Meanwhile, the dry apparatus 100 according to the various embodiments of the disclosure may perform a dry process appropriate for a subject to be dried by using the sensing device 200. Then, the dry apparatus 100 may display various objects related to a dry process using the sensing device 200, and thereby provide appropriate information to a user or improve convenience.

Specifically, an operation of displaying a dry course appropriate for a subject to be dried may indicate the function of the dry apparatus 100 to a user.

Meanwhile, through an operation of inspecting the sensing device 200, it may be determined whether the sensing device 200 is defective or is broken. Also, in inspecting the sensing device 200, a user action may be guided by using the display 140 included in the dry apparatus 100. Accordingly, even if the sensing device 200 does not separately include a display, an operation for inspecting the sensing device 200 may be provided to a user. Accordingly, durability of the sensing device 200 can be improved, and the production cost can be reduced.

Meanwhile, in the above, only simple components constituting the dry apparatus 100 were illustrated and described, but in actual implementation, various components may additionally be provided. Explanation in this regard will be made below with reference to FIG. 23.

Figure 3:
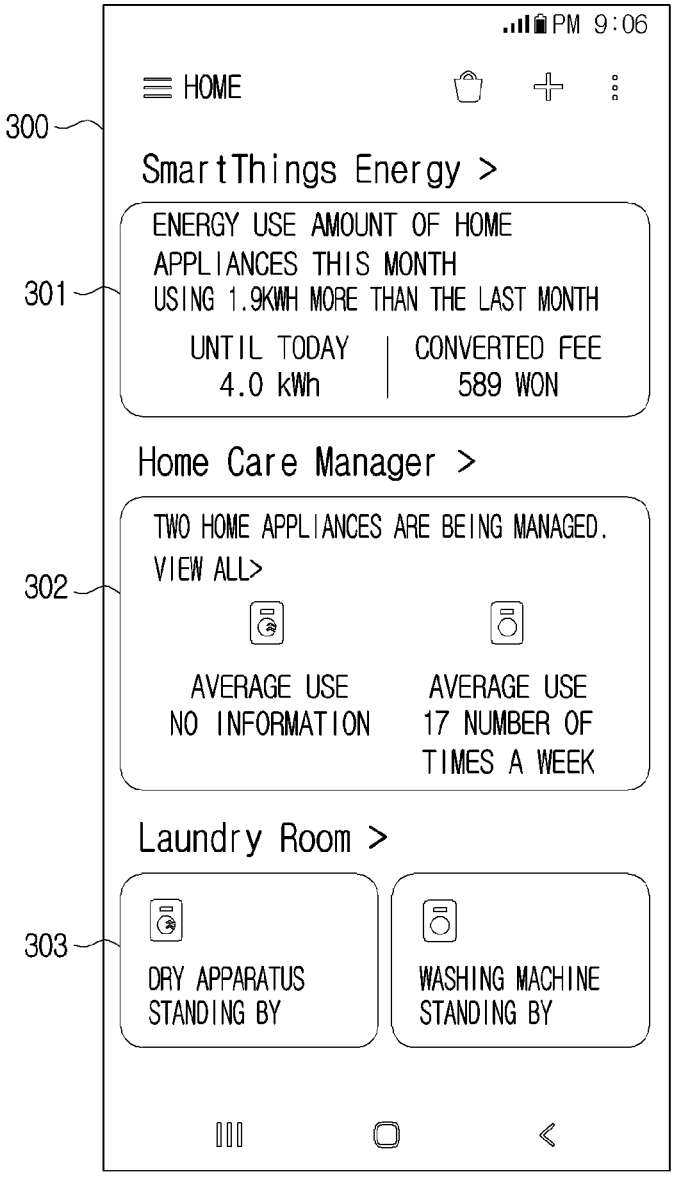
FIG. 3 is a diagram for illustrating a terminal apparatus connected with a dry apparatus.

FIG. 3 is a diagram for illustrating a terminal apparatus connected with a dry apparatus.

Referring to FIG. 3, various kinds of information related to the operations of the dry apparatus 100 may be displayed on a terminal apparatus 300. The terminal apparatus 300 may be a user device registered in the dry apparatus 100 in advance. The dry apparatus 100 may transmit various kinds of information related to a dry process to the terminal apparatus 300. Also, in the terminal apparatus 300, an application displaying the information received from the dry apparatus 100 may be included. Here, the application may be software providing various kinds of objects displaying various kinds of information related to various Internet of Things (IoT) devices registered in the terminal apparatus 300 in advance.

Specifically, the terminal apparatus 300 may display an object 301 indicating a power value or an electricity bill used in a specific space (e.g., a home).

Also, the terminal apparatus 300 may display an object 302 including information related to a home appliance registered in the terminal apparatus 300 in advance. Here, the object 302 may include information on the number of times of using the pre-registered home appliance during a specific period (the average number of times of use).

Also, the terminal apparatus 300 may display an object 303 including the current state information of the pre-registered home appliance.

Figure 4:
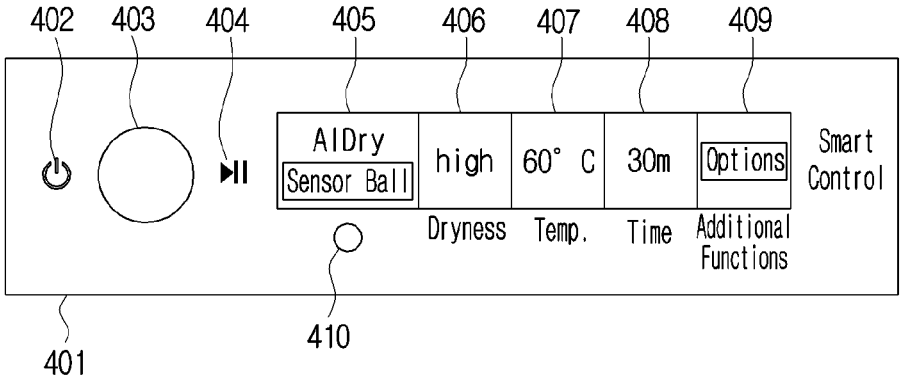
FIG. 4 is a diagram for illustrating a user interface of a dry apparatus.

FIG. 4 is a diagram for illustrating a user interface of a dry apparatus.

Referring to FIG. 4, the front surface panel 401 of the dry apparatus 100 may include a power button 402, a dial 403, a play and pause button 404, a first display 405, a second display 406, a third display 407, a fourth display 408, a fifth display 409, and a control button 410.

Here, the power button 402 may be used to turn on or turn off the power of the dry apparatus 100. Here, the dial 403 may be used for specifying one of a plurality of items. Here, the play and pause button 404 may be used for the start, temporary pause, forced stop, or checking of a dry operation. Here, the first display 405 may be used for displaying various kinds of information related to the operations of the dry apparatus. Here, the second display 406 may be used for displaying information on the dry degree. Here, the third display 407 may be used for displaying the current temperature inside the drum. Here, the fourth display 408 may be used for displaying at least one of the current time or the remaining time of the dry process. Here, the fifth display 409 may be used for displaying additional functions, or displaying icons (options) guiding to display the plurality of additional functions on the first display 405. Here, the control button 410 may be used to check the intent of a user.

Meanwhile, a user may input a user manipulation by directly touching the first display 405 to the fifth display 409, or input a user manipulation by pushing the control button 410.

Figure 5:
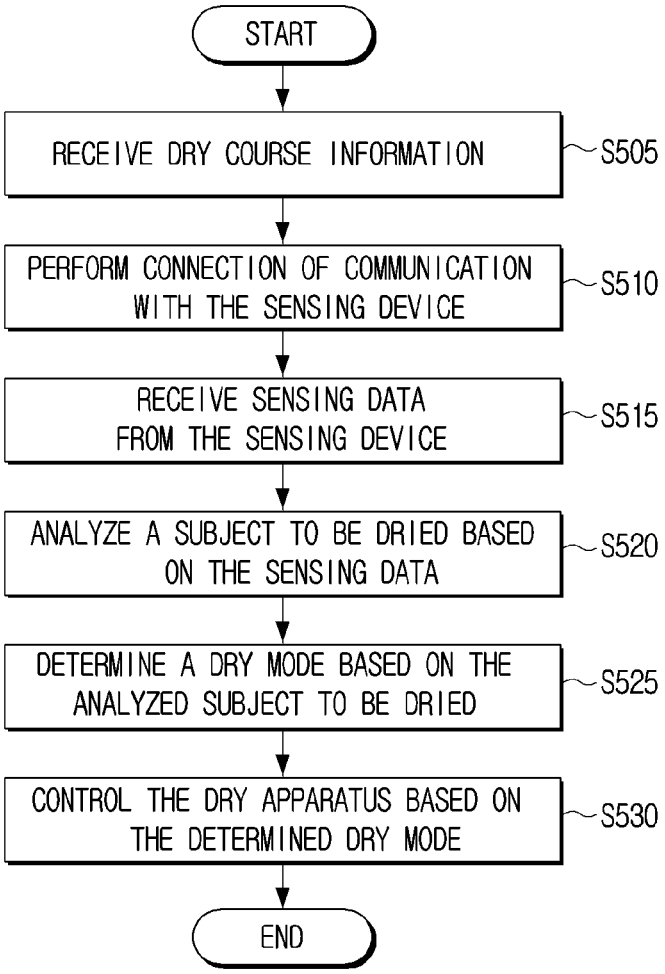
FIG. 5 is a flow chart for illustrating a controlling operation of a dry apparatus according to an embodiment of the disclosure.

FIG. 5 is a flow chart for illustrating a controlling operation of a dry apparatus according to an embodiment of the disclosure.

Referring to FIG. 5, the dry apparatus 100 may receive dry course information from a user in operation S505. Here, the dry course information may be a control command for performing a dry process in a dry mode specified by a user.

Also, the dry apparatus 100 may perform connection of communication with the sensing device 200 in operation S510. Explanation regarding an operation of performing connection of communication with the sensing device 200 will be made below in FIG. 6 and FIG. 7.

Also, the dry apparatus 100 may receive sensing data from the sensing device 200 in operation S515. Then, the dry apparatus 100 may analyze a subject to be dried based on the received sensing data in operation S520. Here, analyzing the subject to be dried may mean determining what kind of subject the subject to be dried is. For example, the analyzing operation may mean identifying whether the subject to be dried is general clothing or bedding.

Also, the dry apparatus 100 may determine a dry mode based on the analyzed subject to be dried in operation S525. Specifically, the dry apparatus 100 may determine an appropriate dry mode such that the subject to be dried is not damaged or deformed. Here, the operation of determining a dry mode may mean determining the setting information of the dry process. Here, the setting information of the dry process may include at least one of the dry time, the dry temperature, the strength of the hot air, or the rotating speed of the drum.

Also, the dry apparatus 100 may control the dry apparatus 100 based on the determined dry mode in operation S530. The dry apparatus 100 may perform the dry process based on the dry mode or the setting information of the dry process acquired through the operation S525.

Figure 6:
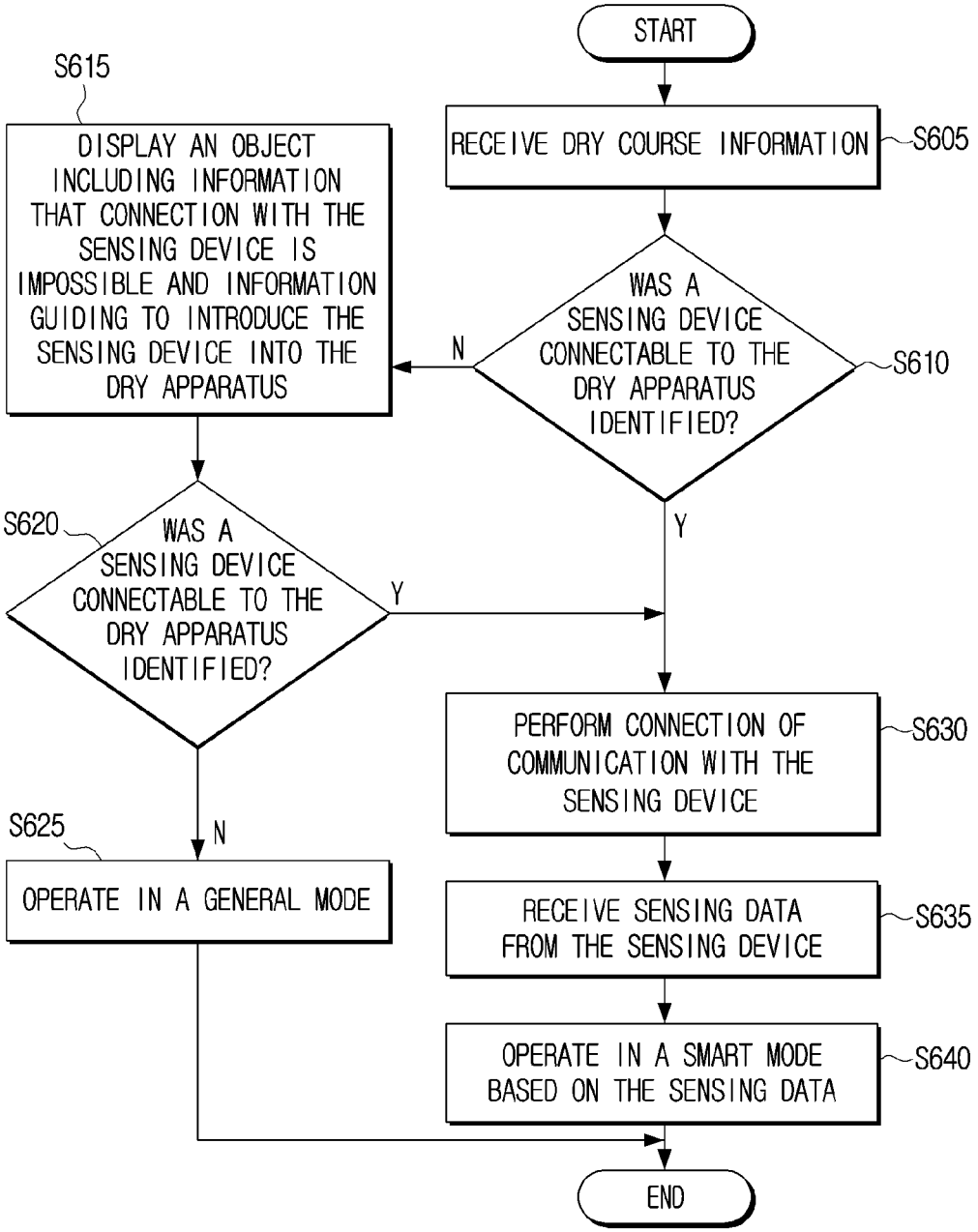
FIG. 6 is a diagram for illustrating a general mode and a smart mode of a dry apparatus.

FIG. 6 is a diagram for illustrating a general mode and a smart mode of a dry apparatus.

Referring to FIG. 6, the dry apparatus 100 may receive dry course information by a user in operation S605. Then, when the dry course information is received by the user, the dry apparatus 100 may identify a sensing device that can be connected with the dry apparatus 100 in operation S610. Specifically, the dry apparatus 100 may broadcast a search signal for identifying a sensing device that can be connected with the dry apparatus 100. Meanwhile, depending on implementation examples, the dry apparatus 100 may search a sensing apparatus registered in advance.

Here, if a sensing device that can be connected with the dry apparatus 100 is identified in operation S610-Y, the dry apparatus 100 may perform connection of communication with the sensing device 200 in operation S630.

Here, if a sensing device that can be connected with the dry apparatus 100 is not identified in operation S610-N, the dry apparatus 100 may display an object including information that connection with a sensing device is not possible and information guiding to introduce a sensing device into the dry apparatus in operation S615. Then, the dry apparatus 100 may determine again whether a sensing device that can be connected with the dry apparatus is identified in operation S620. Here, if a sensing apparatus that can be connected with the dry apparatus 100 is not identified in operation S620-N, the dry apparatus 100 may perform the dry process in a general mode in operation S625. Here, the general mode may mean a mode of performing a dry process without analyzing a subject to be dried by using the sensing device 200.

Here, if a sensing apparatus that can be connected with the dry apparatus is identified in operation S620-Y, the dry apparatus 100 may perform connection of communication with the sensing device 200 in operation S630.

Also, after performing connection of communication with the sensing device 200, the dry apparatus 100 may acquire sensing data from the sensing device 200 in operation S635. Then, the dry apparatus 100 may perform the dry process in a smart mode based on the received sensing data in operation S640. Here, the smart mode may mean a mode wherein a subject to be dried is analyzed by using the sensing device 200, and the dry process is performed in a dry mode appropriate for the analyzed subject to be dried.

Figure 7:
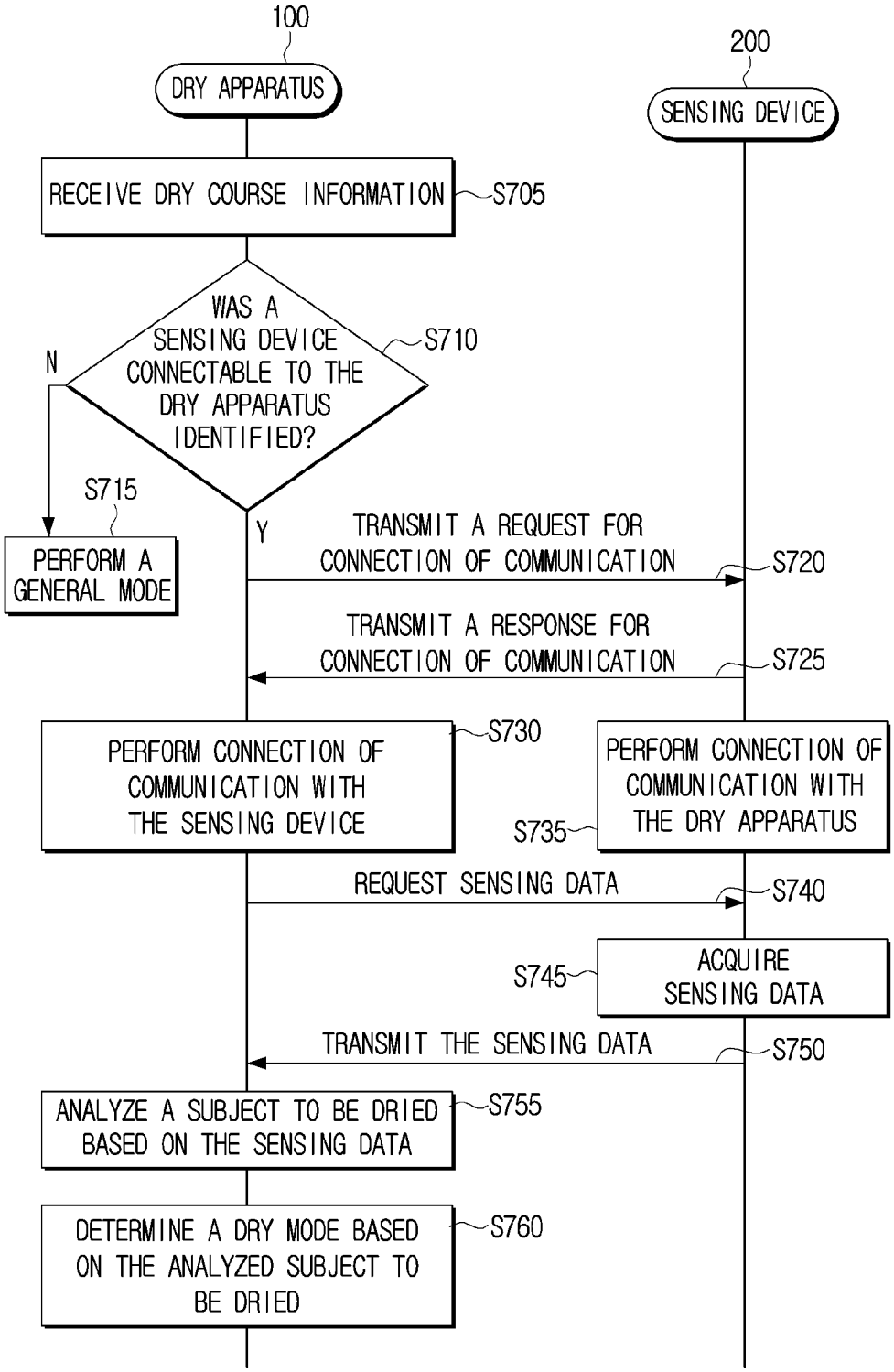
FIG. 7 is a flow chart for illustrating a controlling operation between a dry apparatus and a sensing device.

FIG. 7 is a flow chart for illustrating a controlling operation between a dry apparatus and a sensing device.

Referring to FIG. 7, the dry apparatus 100 may receive dry course information in operation S705. Then, the dry apparatus 100 may identify a sensing device that can be connected with the dry apparatus 100 in operation S710. Here, if a sensing device that can be connected with the dry apparatus 100 is not identified in operation S710-N, the dry apparatus 100 may perform the dry process in the general mode wherein the sensing device 200 is not used in operation S715.

If a sensing device that can be connected with the dry apparatus 100 is identified in operation S715-Y, the dry apparatus 100 may transmit a request for connection of communication to the sensing device 200 in operation S720. Then, the sensing device 200 may generate a response for connection of communication based on the request for connection of communication received from the dry apparatus 100, and transmit the generated response for connection of communication to the dry apparatus 100 in operation S725.

When the dry apparatus 100 receives the response for connection of communication from the sensing device 200, it may perform connection of communication with the sensing device 200 in operation S730. Then, after the sensing device 200 transmits the response for connection of communication to the dry apparatus 100, the sensing device 200 may perform connection of communication with the dry apparatus 100 in operation S735.

After connection of communication between the dry apparatus 100 and the sensing device 200 is performed, the dry apparatus 100 may request sensing data to the sensing device 200 in operation S740. Then, when the request for sensing data is received from the dry apparatus 100, the sensing device 200 may acquire sensing data by using a sensor included in the sensing device 200 in operation S745. Then, the sensing device 200 may transmit the acquired sensing data to the dry apparatus 100 in operation S750.

The dry apparatus 100 may analyze a subject to be dried based on the sensing data acquired from the sensing device 200 in operation S755. Then, the dry apparatus 100 may determine a dry mode based on the analyzed subject to be dried in operation S760.

Figure 8:
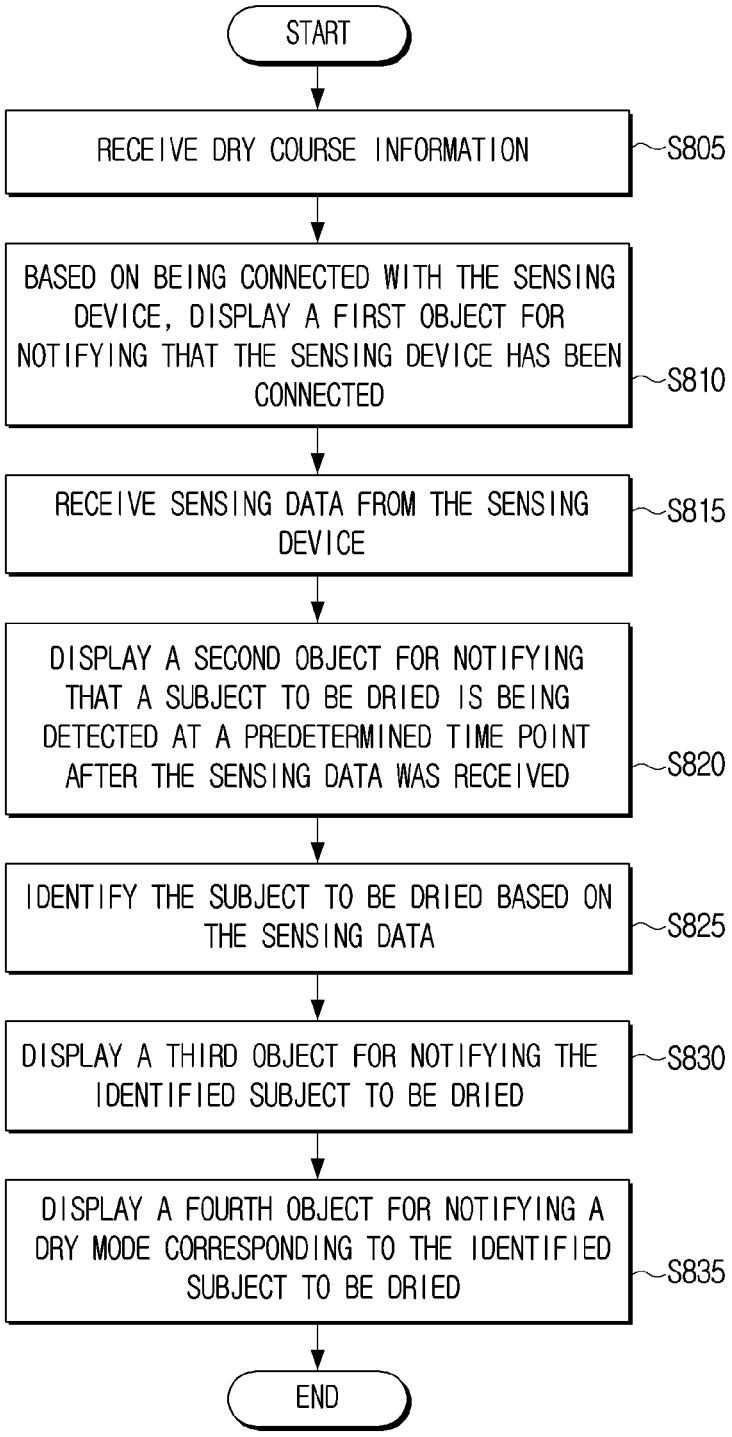
FIG. 8 is a flow chart for illustrating an operation of displaying an object according to various embodiments.

FIG. 8 is a flow chart for illustrating an operation of displaying an object according to various embodiments.

Referring to FIG. 8, the dry apparatus 100 may receive dry course information in operation S805. Then, when the dry apparatus 100 is connected with a sensing device, the dry apparatus 100 may display a first object for indicating that a sensing device has been connected in operation S810. Here, the first object may be the object 1122 in FIG. 11.

Also, the dry apparatus 100 may receive sensing data from the sensing device 200 in operation S815. Then, after the sensing data is received, the dry apparatus 100 may display a second object for indicating that a predetermined subject to be dried is detected in operation S820. Here, the operation of detecting the subject to be dried may be an operation of identifying the subject to be dried. Here, the second object may be the object 1123 in FIG. 11.

Here, the dry apparatus 100 may identify the subject to be dried based on the sensing data in operation S825. Then, the dry apparatus 100 may display a third object for indicating the identified subject to be dried in operation S830. Here, the third object may be the object 1123 in FIG. 11.

Then, the dry apparatus 100 may display a fourth object for indicating a dry mode corresponding to the identified subject to be dried. Here, the fourth object may be the object 1211 in FIG. 12.

FIG. 9 is a flow chart for illustrating an operation of displaying an object according to another embodiment.

Referring to FIG. 9, the dry apparatus 100 may perform a dry process based on a user command in operation S905. In performing the dry process, the dry apparatus 100 may acquire an expected time. Here, the expected time may mean a time that is spent for the dry process to be completed.

Here, the dry apparatus 100 may identify whether the dry process was completed before the expected time in operation S910. If the dry process was not completed before the expected time in operation S910-N, the dry apparatus 100 may identify whether the dry process has been currently completed in operation S915.

If the dry process has not been currently completed in operation S915-N, the dry apparatus 100 may display a fifth object for indicating that an additional dry process will be performed in operation S920. Here, the fifth object may be the object 1221 in FIG. 12.

If the dry process has been currently completed in operation S915-Y, the dry apparatus 100 may display a sixth object for indicating that the dry process has been completed in operation S925. Here, the sixth object may be the object 1222 in FIG. 12.

Meanwhile, if the dry process is completed before the expected time in operation S910-Y, the dry apparatus 100 may display a seventh object for indicating a difference between the expected time and the dry completion time in operation S930. Here, the seventh object may be the object 1212 in FIG. 12.

Figure 10:
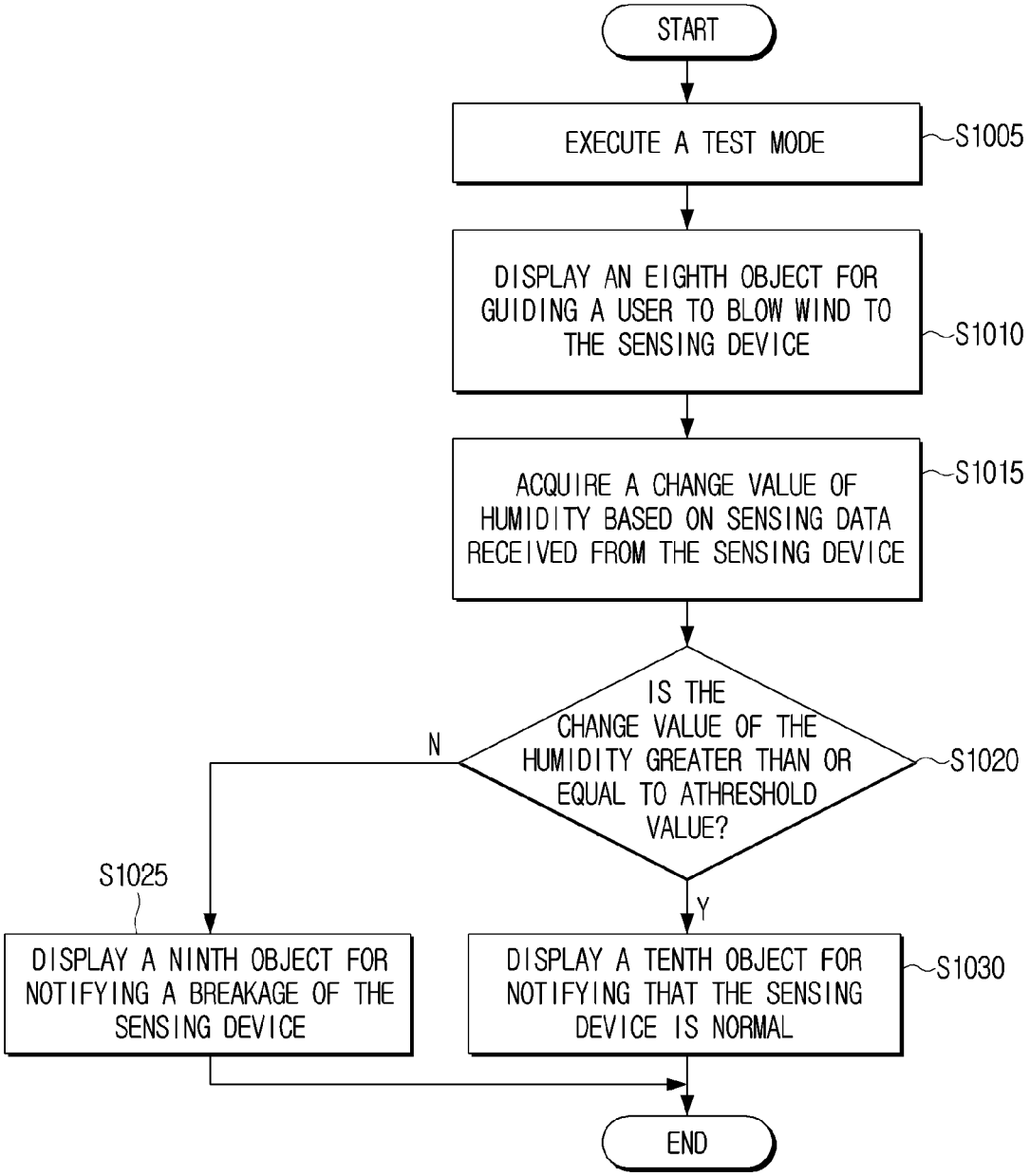
FIG. 10 is a flow chart for illustrating an operation of displaying an object in a test mode.

FIG. 10 is a flow chart for illustrating an operation of displaying an object in a test mode.

Referring to FIG. 10, the dry apparatus 100 may receive a user input for executing a test mode by a user in operation S1005. Here, the test mode may be a mode for testing whether the sensing device 200 operates normally.

Here, the dry apparatus 100 may display an eighth object for guiding a user to blow wind to the sensing device 200 in operation S1010. Here, the eighth object may be the object 1420 in FIG. 14.

Then, the dry apparatus 100 may acquire a change value of the humidity based on the sensing data received from the sensing device 200 in operation S1015. When the test mode is executed, the dry apparatus 100 may request the sensing device 200 to transmit humidity data during a predetermined time. The sensing device 200 may transmit the sensing data to the dry apparatus 100 during a predetermined time from the time when the test mode was executed. Depending on implementation examples, the sensing device 200 may transmit first sensing data to the dry apparatus 100 at the time when the test mode was executed, and transmit second sensing data to the dry apparatus 100 at the time when the predetermined time passed from the time when the test mode was executed. Then, the dry apparatus 100 may acquire a change value of the humidity during the predetermined time based on the sensing data received from the sensing device 200.

Here, the dry apparatus 100 may identify whether the change value of the humidity is greater than or equal to a threshold value in operation S1020. If the change value of the humidity is smaller than the threshold value in operation S1020-N, the dry apparatus 100 may display a ninth object for indicating a breakage of the sensing device 200 in operation S1025. Here, the ninth object may be the object 1425 in FIG. 14.

If the change value of the humidity is greater than or equal to the threshold value in operation S1020-Y, the dry apparatus 100 may display a tenth object for indicating that the sensing device is normal. Here, the tenth object may be the object 1430 in FIG. 14.

Figure 11:
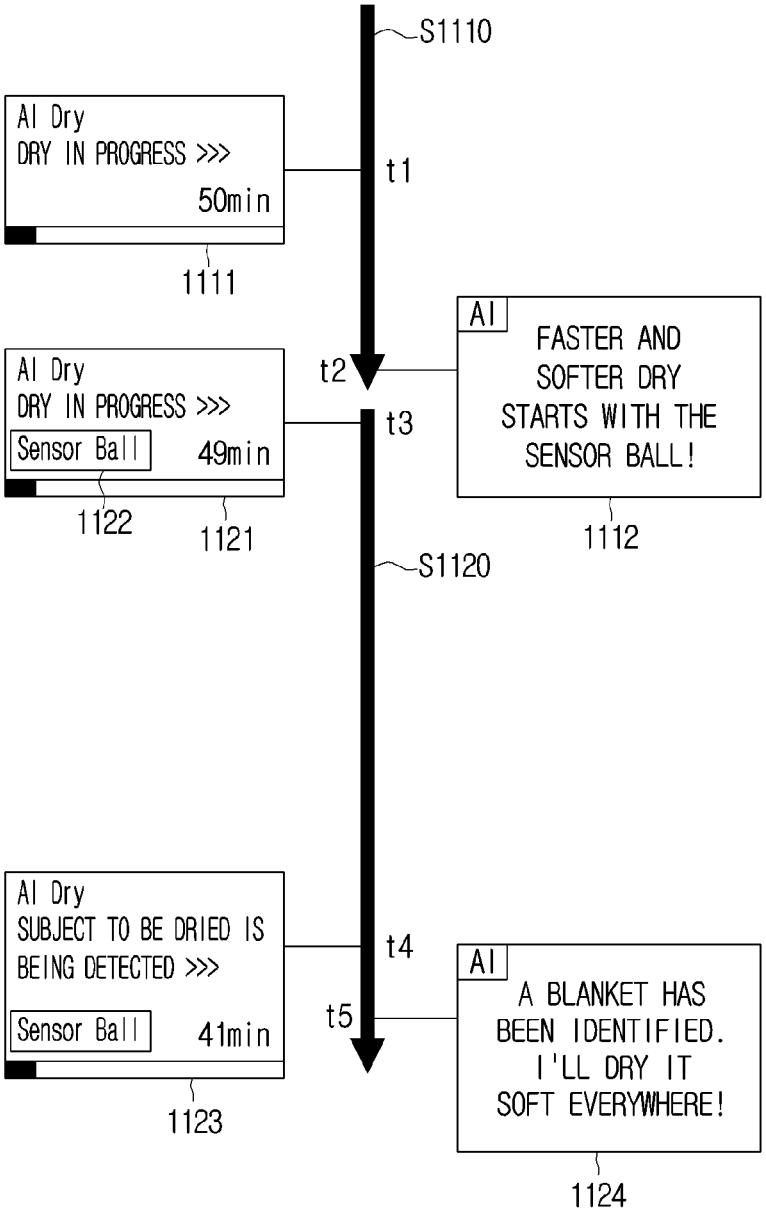
FIG. 11 is a diagram for illustrating an object displayed according to an embodiment.

FIG. 11 is a diagram for illustrating an object displayed according to an embodiment.

Referring to FIG. 11, the dry apparatus 100 may perform a dry process based on a user input in operation S1110. Here, the dry apparatus 100 may display an object 1111 indicating that a dry process is performed at the time t1 when the dry process starts. Specifically, the dry apparatus 100 may display at least one of the dry mode information corresponding to the user input, the state information of the dry process, or the remaining time information of the dry process. For example, the object 1111 may include information that the current dry mode is an AI dry mode, and the dry process is currently performed, and the remaining time of 38 minutes remains.

Also, if the sensing device 200 that can be connected with the dry apparatus 100 is identified, the dry apparatus 100 may detect a subject to be dried by using the sensing device 200 in operation S1120. Specifically, if the sensing device 200 is identified, the dry apparatus 100 may display an object 1112 indicating that the dry process will be performed by using the sensing device 200 at the time t2 when the sensing device 200 was identified. For example, the object 1112 may include information which is 'faster and softer dry starts with a sensor ball!'

Also, if the sensing device 200 is identified, the dry apparatus 100 may display an object 1121 for indicating that a sensing device is identified at the time t3 after the sensing device 200 was identified. Here, the object 1121 may include the object 1111 previously displayed based on the user input as it is, and may additionally include an object 1122 related to the sensing device 200. For example, the object 1122 may be a text which is 'sensor ball,' or an icon or an image corresponding to a sensor ball.

Meanwhile, the dry apparatus 100 may identify a subject to be dried by using the sensing device 200 in operation S1120. Here, the time of identifying a subject to be dried may have been determined in advance. The dry apparatus 100 may receive sensing data from the sensing device 200 during a first threshold time. Then, the dry apparatus 100 may identify the subject to be dried based on the sensing data received during the first threshold time.

Here, the dry apparatus 100 may display an object 1123 for indicating that the subject to be dried is detected during a second threshold time t4 smaller than the first threshold time. For example, the object 1123 may include text information which is 'the subject to be dried is detected.'

Here, the second threshold time may come earlier than the first threshold time. For example, the first threshold time may be ten minutes, and the second threshold time may be nine minutes. The dry apparatus 100 may display the object 1123 for indicating that the subject to be dried is detected during the second threshold time which is before the first threshold time for detecting the subject to be dried comes.

Here, when the first threshold time passes, the dry apparatus 100 may identify the subject to be dried based on the sensing data received from the sensing device 200. Then, the dry apparatus 100 may display an object 1124 for indicating the identified subject to be dried. For example, the object 1124 may include information which is 'a blanket has been identified' and 'I'll dry it soft everywhere!'

FIG. 12 is a diagram for illustrating an object displayed according to another embodiment.

Referring to FIG. 12, after identifying a subject to be dried, the dry apparatus 100 may determine a dry mode appropriate for the identified subject to be dried. Then, the dry apparatus 100 may perform a dry process based on the determined dry mode in operation S1210. Here, the dry apparatus 100 may display an object 1211 for indicating the determined dry mode at the time t6 of performing a dry process based on the determined dry mode. For example, the object 1211 may include information which is 'blanket-customized dry is in progress.'

Then, the dry apparatus 100 may keep receiving sensing data from the sensing device 200 while performing the dry process. The dry apparatus 100 may change the setting information of the dry process based on the sensing data received in real time. For example, even if 10 minutes of the dry process is left, if it is determined that the dry degree is already high, the dry apparatus 100 may finish the dry process.

If the dry is completed faster than the expected time, the dry apparatus 100 may display an object 1212 for indicating that the dry was completed faster than the expected time at the time t7 when the dry was completed. Specifically, the dry apparatus 100 may display a difference value between the expected time and the completion time of the dry. For example, the object 1212 may include information which is 'the dry was completed five minutes faster.'

The dry apparatus 100 may perform the dry process exceeding the expected time based on the sensing data in operation S1220. If it is determined that the dry will be completed later than the expected time, the dry apparatus 100 may display an object 1221 for indicating that an additional dry process is performed at the expected time t8. For example, the object 1221 may include information, such as 'the subject is drying more perfectly.'

Then, when the dry process is completed, the dry apparatus 100 may display an object 1222 for indicating the completion of the dry process at the time t9 when the dry process was completed. For example, the object 1222 may include information which is 'smart dry has been completed.'

Figure 13:
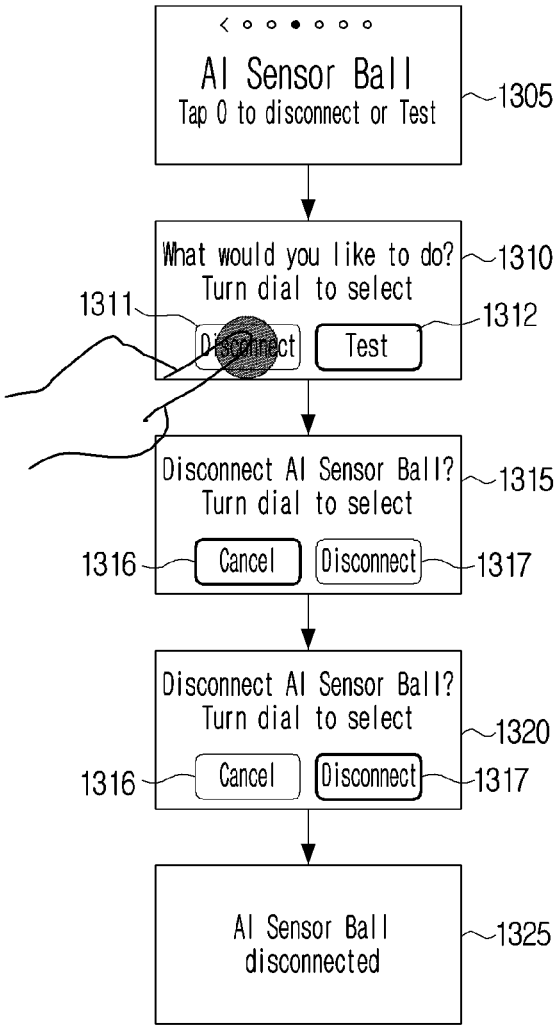
FIG. 13 is a diagram for illustrating an object displayed in an operation of disconnecting a communicative connection between a dry apparatus and a sensing device.

FIG. 13 is a diagram for illustrating an object displayed in an operation of disconnecting a communicative connection between a dry apparatus and a sensing device.

Referring to FIG. 13, if the dry apparatus 100 identifies the sensing device 200 that can be connected with the dry apparatus 100, the dry apparatus 100 may display an object according to the various embodiments. Specifically, if an input of a dry course of a user is received, the dry apparatus 100 may indicate that the sensing device 200 was identified, and display an object 1305 for inquiring whether to perform release of connection or a test. For example, the object 1305 may include information which is 'the sensor ball has been connected.' Here, the dry apparatus 100 may display information inquiring whether to perform release of connection or a test on the sensing device 200. For example, the object 1305 may include information which is 'Please press O for release of connection or a test.' Here, the O button may be the control button 410 in FIG. 4.

Also, if it is identified that the control button 410 was pressed, the dry apparatus 100 may display an object 1310 inquiring whether to perform release of connection or a test. The object 1310 may include a connection release item 1311 and a test item 1312, respectively. Also, the object 1310 may include information to use the dial for selecting the connection release item 1311 or the test item 1312. Here, the dial may be the dial 403 in FIG. 4. For example, the object 1310 may include information which is 'What is the item you want? Please choose by turning the dial.'

Also, if it is identified that the connection release item was selected by the user, the dry apparatus 100 may display an object 1315 inquiring whether to perform release of connection again. In addition, the dry apparatus 100 may display an item 1316 cancelling release of connection and an item 1317 finalizing release of connection for the user's selection. For example, the object 1315 may include information which is 'Would you like to release connection of the sensor ball? Please choose by turning the dial.'

Further, if an input that the user turns the dial is received, the dry apparatus 100 may change an activated item. For example, at the object 1315, the item 1316 cancelling release of connection may be in an activated state. Here, if the user turns the dial, the dry apparatus 100 may display an object 1320 wherein the activated window was changed from the item 1316 cancelling release of connection to the item 1317 finalizing release of connection.

Also, if an input that the user selects the item 1317 finalizing release of connection is received, the dry apparatus 100 may display an object 1325 for indicating that release of connection has been finalized. For example, the object 1325 may include information which is 'the connection of the sensor ball has been released.'

FIG. 14 is a diagram for illustrating an object displayed in an operation of testing a sensing device.

Referring to FIG. 14, if an input of a dry course by a user is received, the dry apparatus 100 may indicate that the sensing device 200 was identified, and display an object 1405 for inquiring whether to perform release of connection or a test. Also, if it is identified that the control button 410 was pressed, the dry apparatus 100 may display an object 1410 inquiring whether to perform release of connection or a test. Here, the object 1405 may correspond to the object 1305 in FIG. 13, and the object 1410 may correspond to the object 1310 in FIG. 13. Accordingly, overlapping explanation will be omitted.

Meanwhile, if an input that the user selects the test item 1412 between the connection release item 1411 and the test item 1412 is received, the dry apparatus 100 may display an object 1415 for guiding a specific user action. Here, the specific user action may mean an action necessary for testing the sensing device 200. For example, the object 1415 may include information which is 'Please shake the sensor ball for 10 seconds, and then press the O button.'

Here, it is assumed that the user shook the sensing device 200 for 10 seconds, and then pressed the O button. The sensing device 200 may acquire movement amount information, and transmit the acquired movement amount information to the dry apparatus 100. The dry apparatus 100 may determine whether the movement amount is measured normally based on the received movement amount information. Accordingly, if the movement amount information is received from the sensing device 200 during a predetermined period after the object 1415 is displayed, the dry apparatus 100 may determine whether the sensing device 200 operates normally based on the received movement amount information.

Also, if it is identified that the sensing device 200 can measure the movement amount information normally, the dry apparatus 100 may display an object 1420 for guiding another user action. For example, the object 1420 may include information which is 'Please blow wind to the sensor ball, and then press the O button.

Here, it is assumed that the user blew wind to the sensing device 200, and then pressed the O button. The dry apparatus 100 may acquire humidity information, and transmit the information to the dry apparatus 100. The dry apparatus 100 may determine whether the humidity is measured normally based on the received humidity information. Accordingly, if humidity information is received from the sensing device 200 during a predetermined period after the object 1420 is displayed, the dry apparatus 100 may determine whether the sensing device 200 operates normally based on the received humidity information.

Specifically, if a change value of the humidity is smaller than a threshold value, the dry apparatus 100 may identify that the sensing device 200 operates abnormally. Then, the dry apparatus 100 may display an object 1425 for indicating that the sensing device 200 operates abnormally. For example, the object 1425 may include information which is 'Please call the service center (1-800-726-7864).'

Also, if the change value of the humidity is greater than or equal to the threshold value, the dry apparatus 100 may identify that the sensing device 200 operates normally. Then, the dry apparatus 100 may display an object 1430 for indicating that the sensing device 200 operates normally. For example, the object 1430 may include information which is 'the sensor ball is operating normally.'

Figure 15:
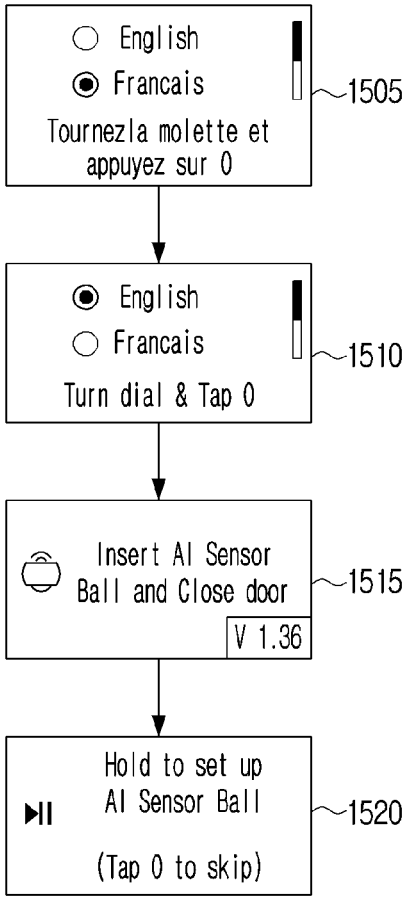
FIG. 15 is a diagram for illustrating an object displayed in an operation for an initial setting of a sensing device.

FIG. 15 is a diagram for illustrating an object displayed in an operation for an initial setting of a sensing device.

Referring to FIG. 15, in case the sensing device 200 is initially connected to the dry apparatus 100, the dry apparatus 100 may display various objects. Specifically, the dry apparatus 100 may display an object 1505 for selection of a language. For example, the object 1505 may display an English item or a French item. Here, in case the user selected the English item, the dry apparatus 100 may display an object 1510 including information written in English.

Ultimately, if it is identified that the user selected English as the control language of the sensing device 200, the dry apparatus 100 may display an object 1515 for guiding a specific user action. For example, the object 1515 may include information which is 'Please put the sensor ball into the drum and close the drum.'

Also, if closing of the door is identified, the dry apparatus 100 may display an object 1520 for guiding another user action. For example, the object 1520 may include information which is 'Please press the icon displayed on the screen for three seconds.' Here, the icon may be the play and pause button 404 in FIG. 4.

Figure 16:
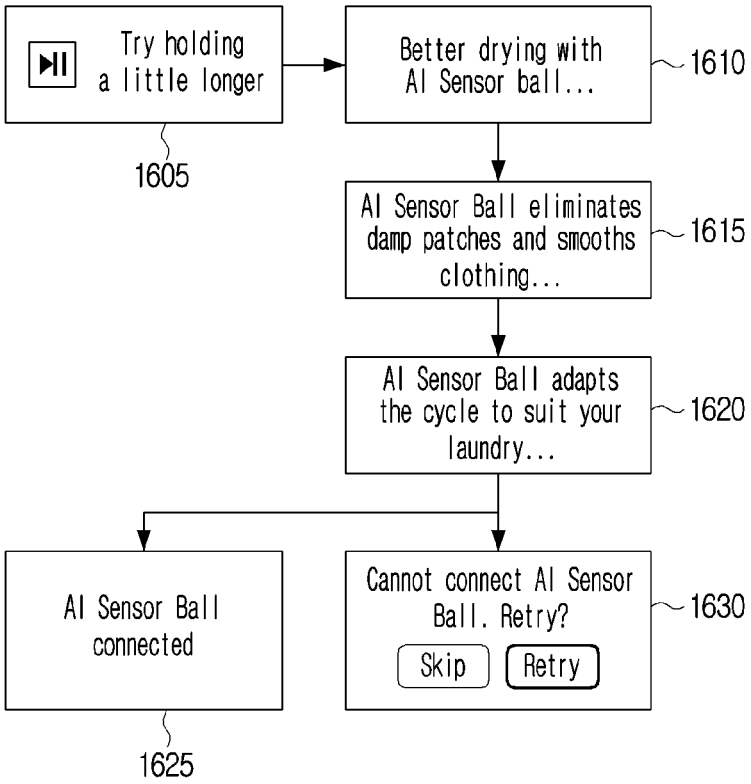
FIG. 16 is a diagram for illustrating an object displayed in another operation for an initial setting of a sensing device.

FIG. 16 is a diagram for illustrating an object displayed in another operation for an initial setting of a sensing device.

Referring to FIG. 16, in case the icon displayed on the object 1520 was not pressed for a threshold time (e.g., three seconds) or longer, the dry apparatus 100 may display an object 1605 for guiding to press the icon longer. For example, the object 1605 may include information which is 'Please press the icon displayed on the screen longer.'

Meanwhile, if it is identified that the icon displayed on the object 1520 was pressed for the threshold time (e.g., three seconds) or longer, the dry apparatus 100 may attempt connection of communication with the sensing device 200. Here, while the dry apparatus 100 attempts connection of communication with the sensing device 200, the dry apparatus 100 may display at least one object 1610, 1615, 1620 for indicating that the dry process is performed by using the sensing device 200. For example, the object 1610 may include information which is 'better dry proceeds with the sensor ball.' Also, the object 1615 may include information which is 'stains can be removed and the cloth can be softened with the sensor ball.' Further, the object 1620 may include information which is 'a mode appropriate for the cloth will be applied with the sensor ball.'

Meanwhile, if connection of communication with the sensing device 200 succeeds, the dry apparatus 100 may display an object 1625 indicating that connection of communication with the sensing device 200 was performed. For example, the object 1625 may include information which is 'the sensor ball has been connected.'

Meanwhile, if connection of communication with the sensing device 200 fails, the dry apparatus 100 may indicate that connection of communication with the sensing device 200 failed, and display an object 1630 inquiring whether to reattempt. For example, the object 1630 may include information which is 'The device cannot be connected with the sensor ball. Would you like to reattempt?' Here, the object 1630 may include a connection omission item and a reattempt item that can be selected by the user.

Figure 17:
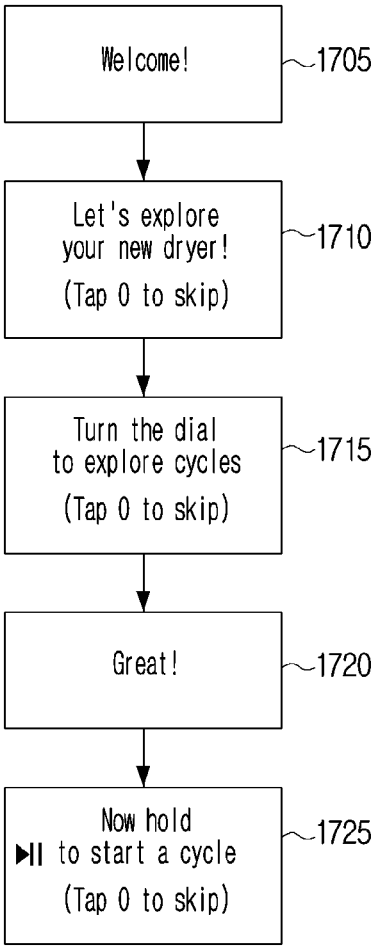
FIG. 17 is a diagram for illustrating an object displayed in an operation of guiding a manipulation of a dry apparatus.

FIG. 17 is a diagram for illustrating an object displayed in an operation of guiding a manipulation of a dry apparatus.

Referring to FIG. 17, when initial setting of the sensing device 200 is completed, the dry apparatus 100 may display various objects for guiding the manipulation of the dry apparatus 100. Here, the meaning of completion of the initial setting of the sensing device 200 may be that connection of communication with the sensing device 200 succeeded, and that a control command for omitting connection of communication was received from a user after connection of communication with the sensing device 200 failed. For example, it may mean that at the object 1630 in FIG. 16, the user selected the connection omission item.

The dry apparatus 100 may display at least one object 1705, 1710 for initial guiding. For example, the object 1705 may display information which is 'Welcome.' Also, the object 1710 may include information which is 'Let's find about the dry apparatus.' Here, the object 1710 may include information guiding to select the control button 410 for omitting an operation for initial guiding to the user. For example, the object 1710 may include information which is 'Please press the O button to omit guide.'

Also, if the control button 410 is not pressed during the threshold time, the dry apparatus 100 may display an object 1715 for guiding a specific user action of the user. Here, the object 1715 may include information guiding to manipulate the user interface of the dry apparatus 100. For example, the object 1715 may include information which is 'Please turn the dial.' Here, the dial may be the dial 403 in FIG. 4. Here, the object 1715 may include information guiding to select the control button 410 for omitting an operation for initial guiding to the user.

If an input corresponding to a guided specific user action (e.g., turning the dial) is received within the threshold time after the object 1715 is displayed, the dry apparatus 100 may display an object 1720 indicating that the user succeeded in the specific action. For example, the object 1720 may include information which is 'Good' or 'You succeeded.'

Then, after the object 1720 is displayed, the dry apparatus 100 may display an object 1725 for guiding another user action. For example, the object 1725 may include information which is 'Please press the icon displayed on the screen for three seconds or longer.' Here, the icon may correspond to the play and pause button 404 in FIG. 4. Here, the object 1725 may include information guiding to select the control button 410 for omitting an operation for initial guiding to the user.

Figure 18:
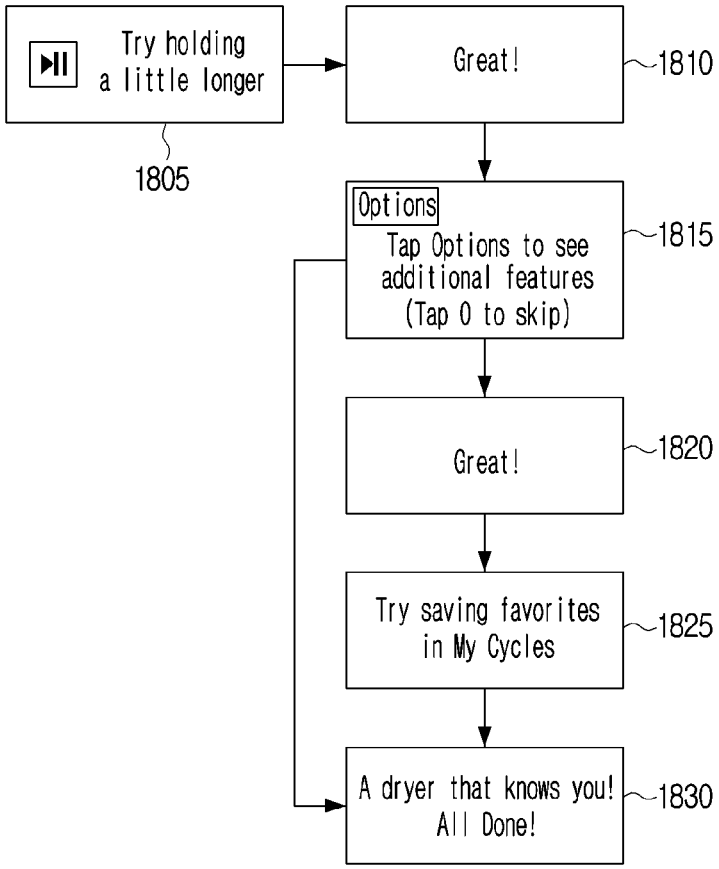
FIG. 18 is a diagram for illustrating an object displayed in another operation of guiding a manipulation of a dry apparatus.

FIG. 18 is a diagram for illustrating an object displayed in another operation of guiding a manipulation of a dry apparatus.

Referring to FIG. 18, if it is identified that the icon displayed on the object 1725 was not pressed for the threshold time (e.g., three seconds) or longer, the dry apparatus 100 may display an object 1805 for guiding to press the icon longer. For example, the object 1805 may include information which is 'Please press the icon displayed on the screen longer.'

Here, if it is identified that the icon was pressed for the threshold time or longer after the object 1725 was displayed, the dry apparatus 100 may display an object 1810 indicating that the user succeeded in a specific action. For example, the object 1810 may include information which is 'Good' or 'You succeeded.'

Then, after the object 1810 was displayed, the dry apparatus 100 may display an object 1815 for guiding another user action. For example, the object 1815 may include information which is 'Please select the icon displayed on the screen.' Here, the icon may mean the icon displayed on the fifth display 409 in FIG. 4, and it may be related to an additional function.

Also, if it is identified that a specific icon was selected after the object 1810 was displayed, the dry apparatus 100 may display an object 1820 indicating that the user succeeded in a specific action. For example, the object 1820 may include information which is 'Good' or 'You succeeded.'

In addition, when the initial guiding operation is completed, the dry apparatus 100 may display objects 1825, 1830 for indicating that the initial guiding operation was completed to the user. For example, the object 1825 may include information which is 'Each user may store a preferred dry mode.' Also, the object 1830 may include information which is 'all guide has been completed.'

Figure 19:
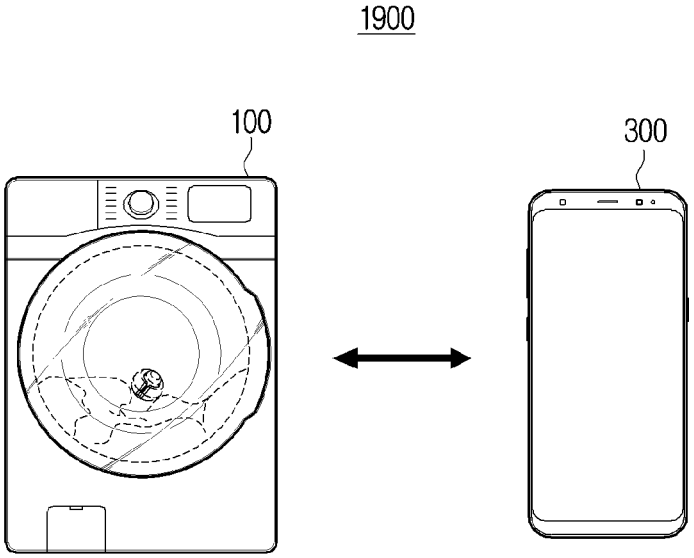
FIG. 19 is a diagram for illustrating a relation between a dry apparatus and a terminal apparatus.

FIG. 19 is a diagram for illustrating a relation between a dry apparatus and a terminal apparatus.

Referring to FIG. 19, the system 1900 may include a dry apparatus 100 and a terminal apparatus 300. Here, the terminal apparatus 300 may be directly connected to the dry apparatus 100. The dry apparatus 100 and the terminal apparatus 300 may be communicatively connected with each other by using near field wireless communication. Here, when connection of communication is performed for the first time, the dry apparatus 100 and the terminal apparatus 300 may perform an operation of registering each other. The reason for performing an operation of registering each other may be for shortening the connection time when reconnecting.

For example, the dry apparatus 100 may transmit sensing data or an analysis result received from the sensing device 200 to the terminal apparatus 300. Also, the terminal apparatus 300 may receive a control command of the user, and transmit the command to the dry apparatus 100.

Figure 20:
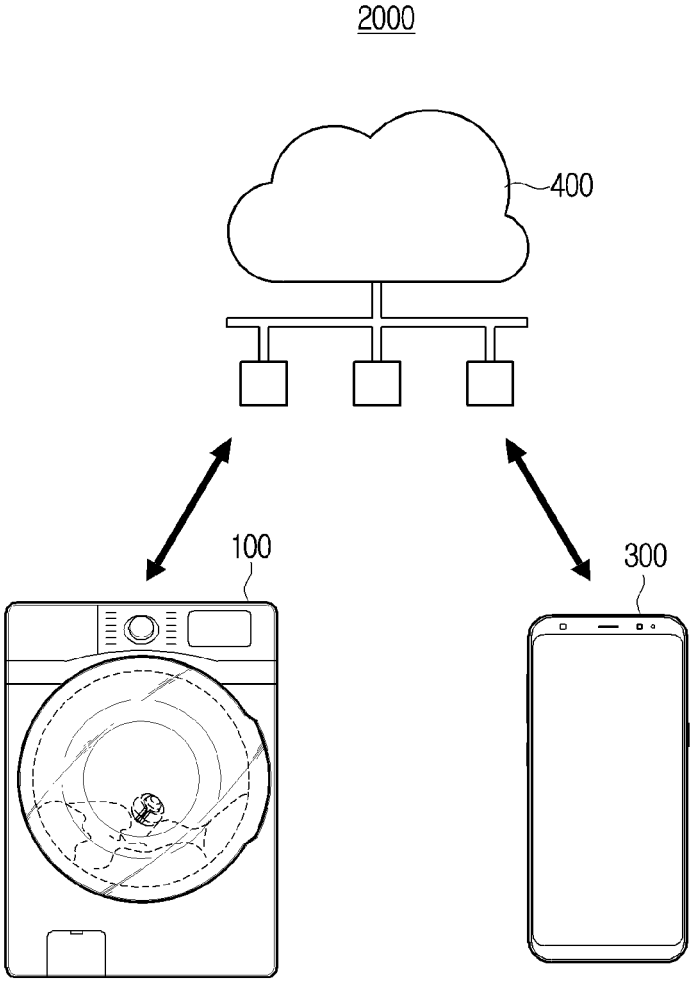
FIG. 20 is a diagram for illustrating a relation among a dry apparatus, a terminal apparatus, and a server.

FIG. 20 is a diagram for illustrating a relation among a dry apparatus, a terminal apparatus, and a server.

Referring to FIG. 20, the system 2000 may include a dry apparatus 100, a terminal apparatus 300, and a server 400. Here, the server 400 may be a network server connecting the dry apparatus 100 and the terminal apparatus 300. Here, the dry apparatus 100 and the terminal apparatus 300 may be connected through the server 400.

For example, the dry apparatus 100 may transmit sensing data or an analysis result received from the sensing device 200 to the terminal apparatus 300 through the server 400. Also, the terminal apparatus 300 may receive a control command of the user, and transmit the command to the dry apparatus 100 through the server 400.

Figure 21:
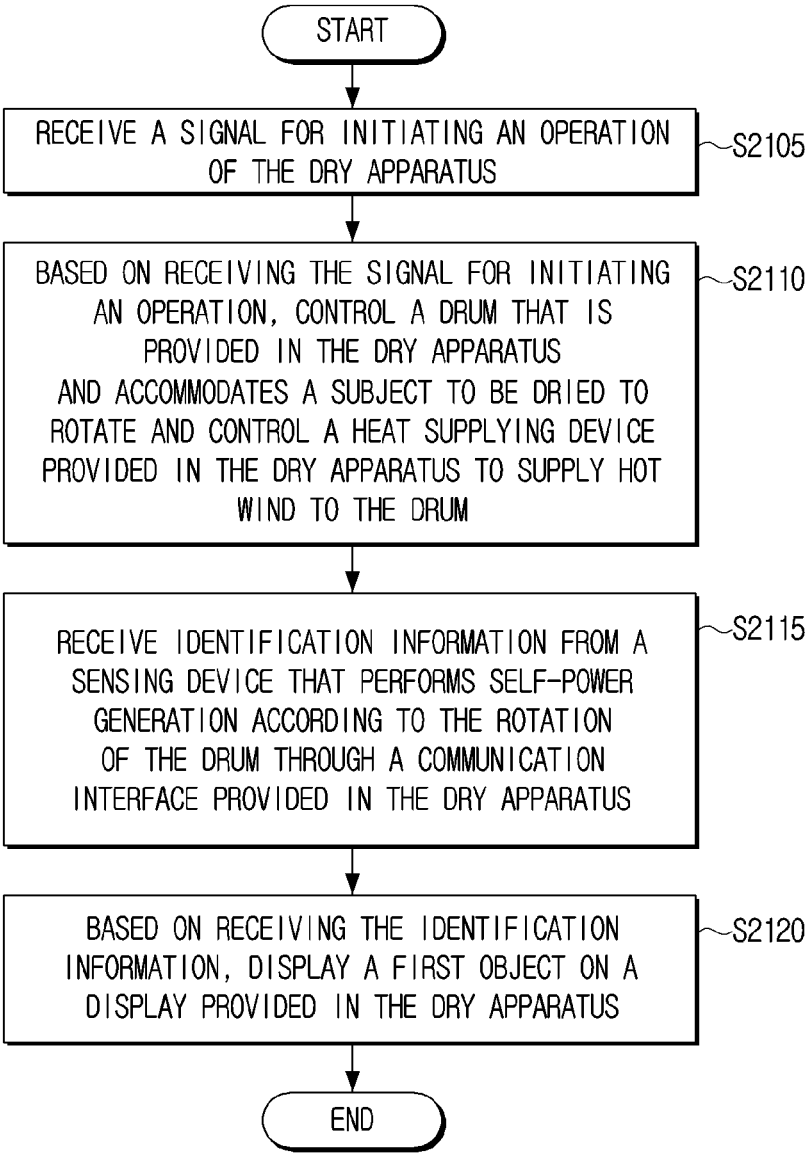
FIG. 21 is a flow chart for illustrating a controlling operation of a dry apparatus according to an embodiment of the disclosure.

FIG. 21 is a flow chart for illustrating a controlling operation of a dry apparatus according to an embodiment of the disclosure.

Referring to FIG. 21, a controlling method of the dry apparatus 100 according to an embodiment of the disclosure includes the steps of receiving a signal for initiating an operation of the dry apparatus 100 (S2105), and based on receiving the signal for initiating an operation, controlling a drum 122 that is provided in the dry apparatus 100 and accommodates a subject to be dried to rotate, and controlling a hot air supplying device 124 provided in the dry apparatus 100 to supply hot air to the drum 122 (S2110), receiving identification information from a sensing device 200 that performs self-power generation according to the rotation of the drum 122 through a communication interface 110 provided in the dry apparatus 100 (S2115), and based on receiving the identification information, displaying a first object on a display 140 provided in the dry apparatus 100 (S2120).

Meanwhile, the first object may include at least one of an icon, a text, or an image for indicating that the sensing device 200 has been connected.

Meanwhile, the controlling method may further include the steps of receiving sensing data from the sensing device 200, and while receiving the sensing data, displaying a second object for indicating that the subject to be dried is detected based on the sensing data.

Meanwhile, the controlling method may further include the step of controlling a rotating operation of the drum 122, and in the step of displaying the second object, based on receiving the sensing data during a first threshold time from the time when the drum 122 started to rotate, the second object may be displayed during a second threshold time smaller than the first threshold time.

Meanwhile, the controlling method may further include the step of outputting a predetermined alarm sound through a speaker 160 at the time when the second object is displayed.

Meanwhile, the controlling method may further include the steps of detecting the subject to be dried based on the sensing data acquired from the sensing device 200, and displaying a third object for indicating the detected subject to be dried.

Meanwhile, the controlling method may further include the step of displaying a fourth object for indicating a dry course corresponding to the subject to be dried detected based on the sensing data acquired from the sensing device 200.

Meanwhile, the controlling method may further include the steps of determining an operation time of the hot air supplying device 124 based on the sensing data acquired from the sensing device 200, and based on the hot air supplying device 124 operating after the determined operation time, displaying a fifth object for indicating an additional operation of the hot air supplying device 124, and based on completing the operation of the hot air supplying device 124, displaying a sixth object for indicating that the operation of the hot air supplying device 124 has been completed.

Meanwhile, the controlling method may further include the steps of determining an operation time of the hot air supplying device 124 based on the sensing data acquired from the sensing device 200, and based on completing the operation of the hot air supplying device 124 before the determined operation time, displaying a seventh object for indicating a difference between the determined operation time and the operation completion time of the hot air supplying device 124.

Meanwhile, the controlling method may further include the steps of, based on receiving a user input for inspecting the sensing device 200, displaying an eighth object for guiding a predetermined user action, acquiring a change value of sensing data acquired from the sensing device 200 that was acquired during a specific time from the time when the eight object was displayed, and based on the change value of the sensing data being smaller than a threshold value, displaying a ninth object for indicating a breakage of the sensing device 200, and based on the change value of the sensing data being greater than or equal to the threshold value, displaying a tenth object for indicating that the sensing device 200 is normal.

Meanwhile, the controlling method of the dry apparatus 100 as in FIG. 21 may be executed in the dry apparatus 100 having a configuration as in FIG. 2, and it may also be executed in the dry apparatus 100 having a different configuration. Meanwhile, FIG. 22 is a block diagram illustrating a dry apparatus according to another embodiment of the disclosure.

Figure 22:
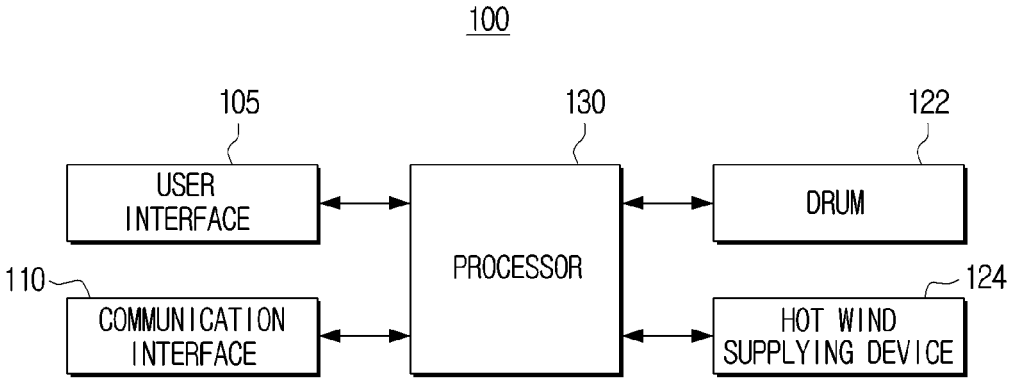
FIG. 22 is a block diagram illustrating a dry apparatus according to another embodiment of the disclosure.

Referring to FIG. 22, the dry apparatus 100 may include a user interface 105, a communication interface 110, a drum 122, a hot air supplying device 124, and a processor 130.

The user interface 105 may be implemented as a device such as a button, a touch pad, a mouse, and a keyboard, or it may also be implemented as a touch screen that can perform the aforementioned display function and a manipulation input function together. Here, the button may be various types of buttons such as a mechanical button, a touch pad, a wheel, etc. formed in any areas such as the front surface part or the side surface part, the rear surface part, etc. of the exterior of the main body of the dry apparatus 100.

The user interface 105 may receive input of a dry course from a user.

The communication interface 110 is a component that performs communication with various types of external apparatuses according to various types of communication methods. For example, the communication interface 110 may include a Wi-Fi module, a Bluetooth module, an infrared communication module, and a wireless communication module, etc. A Wi-Fi module and a Bluetooth module perform communication by a Wi-Fi method and a Bluetooth method, respectively. A wireless communication module may include at least one communication chip performing communication according to various wireless communication protocols such as Zigbee, 3rd Generation (3G), 3rd Generation Partnership Project (3GPP), Long Term Evolution (LTE), LTE Advanced (LTE-A), 4th Generation (4G), 5th Generation (5G), etc. other than the aforementioned communication methods.

The drum 122 may mean a dry tub that accommodates a subject to be dried.

The hot air supplying device 124 may supply a heat source to the drum 122.

Meanwhile, the processor 130 may control a rotating operation of the drum 122, and determine an operation time based on sensing data acquired during a specific time from the time when the drum 122 started to rotate.

For example, if the processor 130 receives a dry course and a command for starting dry through the user interface 105, the processor 130 may start a dry operation. Here, the processor 130 may determine the operation time of the hot air supplying device 124 based on sensing data received from the sensing device 200 during a predetermined time from the time when the dry operation was started to be performed. As an example, the sensing device 200 may regularly transmit the sensing data to the dry apparatus 100, and the dry apparatus 100 may determine the operation time of the hot air supplying device 124 based on the sensing data received from the sensing device 200 during the predetermined time from the time when the dry operation was started to be performed. As another example, the sensing device 200 may acquire sensing data only as much as a specific time from the time when the dry operation was started to be performed.

Here, when the dry operation starts, the processor 130 may transmit a control signal requesting sensing data to the sensing device 200. Depending on implementation examples, the processor 130 may include information on the acquisition time of the sensing data in the control signal requesting the sensing data, and transmit the signal to the sensing device 200. For example, the processor 130 may transmit a control signal requesting to send the sensing data as much as five minutes to the sensing device 200.

Meanwhile, the processor 130 may determine the operation time of the hot air supplying device 124 as a first time based on the dry course, and determine the operation time of the hot air supplying device 124 as a second time based on the sensing data, and the second time may be greater than the first time.

For example, if a command for performing a general dry course is received through the user interface 105, the processor 130 may acquire the first time (e.g., one hour) corresponding to the general dry course, and generate a control command to perform a dry operation as much as the first time. The processor 130 may control the hot air supplying device 124 to operate as much as the first time. Here, the processor 130 may determine the operation time of the hot air supplying device 124 again based on the sensing data. The time determined again based on the sensing data may be the second time. Then, the processor 130 may control the hot air supplying device 124 to operate as much as the second time but not the first time. Here, even though the user instructed the general dry course, in actuality, a situation wherein a longer dry time is needed may occur depending on a subject to be dried. Accordingly, the processor 130 may newly determine the operation time of the hot air supplying device 124 based on the sensing data transmitted by the sensing device 200, and control the hot air supplying device 124 to operate as much as the newly determined second time. Here, the second time may be a bigger value than the first time.

Meanwhile, while the processor 130 controls the operation of the hot air supplying device 124 according to the operation time, the processor 130 may change the operation time based on the humidity or the temperature.

Here, the processor 130 may control the hot air supplying device 124 based on the first time which is a dry time corresponding to the dry course received from the user. Here, the processor 130 may acquire sensing data from the sensing device 200 while operating the hot air supplying device 124. Then, the processor 130 may acquire a temperature or humidity based on the acquired sensing data.

As an example, the sensing device 200 may acquire a temperature or humidity based on the sensing data corresponding to a voltage according to self-power generation, and transmit the acquired temperature or the acquired humidity to the dry apparatus 100.

As another example, the sensing device 200 may transmit sensing data corresponding to a voltage according to self-power generation to the dry apparatus 100, and the dry apparatus 100 may acquire a temperature or humidity based on the acquired sensing data.

Here, the processor 130 may newly determine the dry time based on the acquired temperature or humidity. The newly determined dry time may be the second time.

Here, the processor 130 may compare the first time and the second time, and determine whether to change the dry time. If the second time is bigger than the first time, the processor 130 may change the dry time such that the hot air supplying device 124 operates as much as the second time.

Meanwhile, the processor 130 may receive a signal corresponding to the dry degree of the subject to be dried from the dry degree sensor of the sensing device 200 contacting the subject to be dried accommodated in the drum 122, and the sensing data may include humidity data, and the processor 130 may determine whether to operate the hot air supplying device 124 based on the humidity data acquired after the time that was determined based on the signal transmitted from the dry degree sensor.

The sensing device 200 may include a dry degree sensor. The dry degree sensor may be arranged on the outer surface of the sensing device 200. Also, the dry degree sensor may physically contact a subject to be dried. The sensing device 200 may receive a signal corresponding to the dry degree through the dry degree sensor. Then, the sensing device 200 may include the signal corresponding to the dry degree in the sensing data, and transmit the data to the dry apparatus 100.

Here, the signal corresponding to the dry degree may be a surface voltage value. The sensing device 200 or the dry apparatus 100 may acquire humidity data based on the surface voltage value.

Here, the sensing device 200 may acquire humidity data based on the signal corresponding to the dry degree. Then, the sensing device 200 may transmit the acquired humidity data to the dry apparatus 100. Meanwhile, depending on implementation examples, the sensing device 200 may transmit a signal corresponding to the dry degree to the dry apparatus 100, and the dry apparatus 100 may acquire humidity data based on the signal corresponding to the dry degree.

Here, while the sensing device 200 already performs an operation of controlling the hot air supplying device 124 as the first time corresponding to the dry course, the sensing device 200 may determine a new dry time based on humidity data. Here, the new dry time may be the second time. The processor 130 may determine the second time based on humidity data acquired after a predetermined time from the time when the dry process started. For example, the processor 130 may acquire humidity data five minutes after the dry process started, and determine the second time which is a new dry time based on the acquired humidity data.

Meanwhile, the hot air supplying device 124 may include a heat pump device that heats air by using condensed heat of a refrigerant and a blowing device, and the processor 130 may control the operation of the heat pump device based on the operation time.

Here, the processor 130 may control the operation of the heat pump device included in the hot air supplying device 124 for operating the hot air supplying device 124.

Meanwhile, the sensing device 200 may be a movable sensing device that exists separately from the dry apparatus 100. The sensing device 200 may include an energy harvester that is charged according to the movement of the sensing device 200. Here, the energy harvester may be a device that performs a function of converting potential energy into electronic energy based on the movement of the sensing device 200. Specifically, the energy harvester may acquire a first voltage (or a harvester voltage or a harvesting voltage) according to the movement of the sensing device 200. Then, the sensing device 200 may transmit the acquired first voltage to the dry apparatus 100. The dry apparatus 100 may rotate the drum 122 while performing the dry process. When the drum 122 rotates, the sensing device 200 that exists inside the drum 122 may rotate together, and the sensing device 200 may move up and down by a centrifugal force, etc. The energy harvester included in the sensing device 200 may acquire electronic energy based on potential and kinetic energy. Here, the electronic energy may be expressed as the first voltage.

The processor 130 may acquire a dry time corresponding to the acquired first voltage. Here, a lookup table related to the dry time according to the first voltage having various values may be stored in the memory 150 of the dry apparatus 100. The processor 130 may acquire the dry time corresponding to the first voltage based on the lookup table of the dry time according to the first voltage stored in the memory 150. Then, the processor 130 may perform the dry process as much as the dry time corresponding to the first voltage.

According to an embodiment, the processor 130 may control the dry apparatus 100 such that the total dry process is performed as much as the dry time corresponding to the first voltage.

According to another embodiment, the processor 130 may additionally set the dry time corresponding to the first voltage to the dry time that is currently set as the dry process is performed. The dry time of the subject to be dried may have already been determined as the dry process was performed, and the dry time corresponding to the first voltage may be used in determining whether to grant an additional time.

The processor 130 may acquire the first voltage from the sensing device 200, and acquire (or identify) characteristic information of the subject to be dried based on the acquired first voltage. Specifically, the processor 130 may acquire movement amount information including the moving distance or the moving pattern of the sensing device 200 based on the first voltage, and acquire the characteristic information of the subject to be dried based on the acquired movement amount information.

Here, the first voltage value may be a charging voltage value or a harvester voltage value measured at the energy harvester.

Also, the processor 130 may receive sensing data from the sensing device 200. Here, the sensing device 200 may be located inside the drum 122 of the dry apparatus 100. Here, while the dry process is performed, the drum 122 may rotate, and the sensing device 200 may rotate according to the rotation of the drum 122.

According to another embodiment, the sensing device 200 may include a distance sensor that can measure a movement amount according to a rotation. The distance sensor may acquire a moving distance and a moving coordinate of the sensing device 200. Accordingly, the sensing device 200 may identify how much the sensing device 200 moves, i.e., from which height to which height the sensing device 200 falls through the distance sensor. For example, if it is assumed that the sensing device 200 rotates in a state wherein the diameter of the inside of the drum 122 is 70 cm, the sensing device 200 may fall as much as a distance of between 50 cm and 70 cm whenever the drum 122 rotates. Here, the sensing device 200 may acquire movement amount information, and transmit the acquired movement amount information to the dry apparatus 100 through the communication interface of the sensing device 200. Here, the communication interface of the sensing device 200 may include a wireless communication module. The processor 130 may acquire the movement amount information from the sensing device 200. Then, the processor 130 may acquire characteristic information of the subject to be dried based on the acquired movement amount information.

Also, the dry apparatus 100 may acquire at least one of the load (or the weight), the temperature, or the humidity of the subject to be dried. Here, the dry apparatus 100 may include at least one of a sensor that can measure a load, a temperature sensor, or a humidity sensor. Depending on implementation examples, the dry apparatus 100 may include a camera, and may photograph the subject to be dried inside the drum 122 and acquire the image as image data.

The sensing device 200 may acquire at least one of the movement amount, the first voltage (or the charging voltage or the harvester voltage), the moving pattern, the dry degree, the temperature, or the humidity of the sensing device 200. Here, the sensing device 200 may include at least one of a distance sensor that can measure the movement amount of the sensing device, a harvester voltage measurement sensor according to a movement, a moving pattern analysis module, a contact-type electrode sensor that can measure a dry degree, a temperature sensor, or a humidity sensor.

Meanwhile, the processor 130 may determine a dry time corresponding to the acquired sensing data based on the characteristic information of the subject to be dried, and the characteristic information of the subject to be dried may include at least one of the type information of the subject to be dried, the volume information of the subject to be dried, the material information of the subject to be dried, the shape information of the subject to be dried, or the weight information of the subject to be dried.

Here, the dry apparatus 100 may store a lookup table including the dry time corresponding to the sensing data in the memory 150. Then, the processor 130 may operate the hot air supplying device 124 to perform a dry process as much as the dry time corresponding to the acquired sensing data.

Here, the processor 130 may determine the dry time corresponding to the sensing data by additionally considering the characteristic information of the subject to be dried. Accordingly, even if the sensing data is the same, the dry time may be different according to the characteristic information of the subject to be dried. For example, even if the sensing value acquired from the sensing device 200 is the same, in case the subject to be dried is clothing (characteristic information), the processor 130 may acquire a dry time of one hour, and in case the subject to be dried is bedding (characteristic information), the processor 130 may acquire a dry time of two hours.

Here, the processor 130 may acquire the characteristic information of the subject to be dried based on at least one of the information directly sensed by the dry apparatus 100 or the information directly sensed by the sensing device 200.

As an example, the processor 130 may acquire the characteristic information of the subject to be dried based on the sensing data acquired from the sensing device 200.

As another example, the processor 130 may acquire the characteristic information of the subject to be dried based on the input data directly input by the user.

As still another example, the processor 130 may acquire the characteristic information of the subject to be dried based on the sensing data acquired from a sensor (e.g., a weight sensor or an image sensor) included (installed) in the dry apparatus 100.

As still another example, the processor 130 may acquire the characteristic information of the subject to be dried based on the sensing data acquired from the sensing device 200 and the sensing data acquired from the sensor of the dry apparatus 100 itself.

Here, the processor 130 may acquire sensing data including at least one of the surface dry degree of the subject to be dried, the humidity inside the drum 122, or the temperature inside the drum 122 from the sensing device 200.

The sensing device 200 may acquire a second voltage (or a surface voltage) based on a contact-type electrode sensor, and acquire the humidity information inside the drum 122 or the temperature information inside the drum 122. Then, the sensing device 200 may transmit the acquired surface voltage, humidity information, and temperature information to the dry apparatus 100. The processor 130 may acquire the characteristic information of the subject to be dried based on the sensing data including at least one of the first voltage (or the charging voltage or the harvester voltage), the second voltage (or the surface voltage), the humidity (the humidity inside the dry apparatus), or the temperature (the temperature inside the dry apparatus) received from the sensing device 200.

The type information of the subject to be dried may be information indicating to which category the subject belongs. For example, the type information of the subject to be dried may be clothing, bedding, shirts, or towels. The processor 130 may perform an appropriate dry process based on the type information of the subject to be dried. The type information of the subject to be dried may be classified according to the function of the subject. The processor 130 may determine the type of the subject to be dried based on the movement amount of the sensing device 200. If the movement amount of the subject to be dried is greater than or equal to a first threshold value, the processor 130 may identify that the subject to be dried is clothing.

For example, the volume information of the subject to be dried may mean the total volume of the subject to be dried that exists inside the drum 122. If there is one subject, the volume information may mean one volume, and if there are ten subjects, the volume information may mean ten volumes. The processor 130 may determine the volume of the subject to be dried based on the movement amount of the sensing device 200. The processor 130 may identify the falling distance in the movement amount of the subject to be dried. Then, as the falling distance is bigger, the processor 130 may determine that the volume of the subject to be dried is smaller. Here, the falling distance may mean the distance that the sensing device 200 moved in a vertical direction when the drum 122 rotated once.

The material information of the subject to be dried, and the shape information of the subject to be dried may mean the texture. For example, the material information of the subject to be dried may be cotton, wool, polyester, nylon, silk, denim, leather, cashmere, etc. The material information of the subject to be dried may be classified according to the fabric of the cloth. The processor 130 may determine the material of the subject to be dried based on a moving distance of the sensing device 200 (the moving distance acquired by the first voltage received from the sensing device 200) or the surface voltage acquired from the contact-type electrode sensor. If the frictional force of the material is higher, the moving distance of the sensing device 200 may become shorter, and the surface voltage may be different. Accordingly, the dry apparatus 100 may store a data set according to various materials in advance, and compare the sensed surface voltage value and the data set.

The shape information of the subject to be dried may be information indicating which shape the subject has. For example, the shape information of the subject to be dried may mean a basic shape, a cube shape, a sphere shape, and a cylinder shape. Here, the basic shape may mean a shape that is identified when rotating the drum 122 for drying general clothing, etc. The basic shape may mean a general shape. The processor 130 may determine the shape of the subject to be dried based on the movement amount of the sensing device 200.

The weight information of the subject to be dried may indicate the load of the subject. For example, the weight of the subject to be dried may be a weight in a specific unit such as 5 kg and 10 kg.

Meanwhile, in the aforementioned description, it was described that the processor 130 acquires the characteristic information of the subject to be dried based on the movement amount of the sensing device 200, but the harvester voltage, the moving pattern, the dry degree, the temperature, or the humidity may be additionally considered other than the movement amount of the sensing device 200.

The processor 130 may determine the most appropriate dry method to the subject to be dried by acquiring the characteristic information of the subject to be dried. Specifically, the processor 130 may acquire setting information corresponding to the most appropriate dry process for the subject to be dried. The setting information may include at least one of the dry time, the dry temperature, the strength of hot air, or the rotating speed of the drum 122. For example, if it is identified that the subject to be dried is silk, the processor 130 may determine the dry time, the dry temperature, and the strength of hot air appropriate for silk.

Meanwhile, the processor 130 may acquire the moving distance of the sensing device 200 based on the first voltage, and if the acquired moving distance is greater than or equal to the first threshold value, the processor 130 may control the hot air supplying device 124 to operate as much as the dry time corresponding to clothing, and if the acquired moving distance is smaller than the first threshold value, the processor 130 may control the hot air supplying device 124 to operate as much as the dry time corresponding to bedding.

Here, as the first voltage value (the charging voltage) is higher, the moving distance may be greater. Accordingly, as the acquired first voltage value of the sensing device 200 is higher, the processor 130 may determine that the moving distance of the sensing device 200 is greater.

As clothing generally does not have a big volume, there may be a lot of empty spaces inside the drum 122. In particular, as moist clothing is in a contracted state, there may be a lot of empty spaces inside the drum 122 while a dry process is performed. Accordingly, when drying clothing, there may be a lot of spaces wherein the sensing device 200 can move, and the moving distance of the sensing device 200 may be greater.

In contrast, as bedding has a big volume, there may not be a lot of empty spaces inside the drum 122. Accordingly, when drying bedding, there may not be a lot of spaces wherein the sensing device 200 can move, and the moving distance of the sensing device 200 may be smaller.

The processor 130 may acquire the moving distance of the sensing device 200 at a predetermined time, and if the acquired moving distance is greater than or equal to the first threshold value, the processor 130 may identify that the subject to be dried is clothing. Meanwhile, if the acquired moving distance is smaller than the first threshold value, the processor 130 may identify that the subject to be dried is bedding.

In the aforementioned description or the description below, an operation of identifying clothing or bedding may not be an operation that should necessarily be performed. The processor 130 may determine a dry time based on an acquired moving distance and the first threshold value, without going through an operation of determining (identifying) clothing/bedding.

Depending on implementation examples, the processor 130 may not go through an operation of determining (identifying) clothing/bedding, and if the acquired moving distance is greater than or equal to the first threshold value, the processor 130 may perform a dry process as much as the dry time corresponding to clothing, and if the acquired moving distance is smaller than the first threshold value, the processor 130 may perform a dry process as much as the dry time corresponding to bedding. Here, the operation of performing a dry process may mean rotating the drum 122 or operating the hot air supplying device 124. Here, the predetermined time may be the time when a predetermined time passed after the time when the dry process started. The predetermined time or the predetermined time may be changed according to the user's setting. Also, the first threshold value may be changed according to the user's setting. Meanwhile, depending on implementation examples, if the predetermined time is changed, the first threshold value may also be changed.

Meanwhile, the processor 130 may acquire the moving distance of the sensing device 200 based on the first voltage value, and acquire the second voltage value from the sensing device 200, and acquire the surface dry degree of the subject to be dried based on the second voltage value. Also, if the acquired moving distance is greater than or equal to the first threshold value, the processor 130 may control the hot air supplying device 124 to operate as much as the dry time corresponding to clothing, and if the acquired moving distance is smaller than the first threshold value and the acquired surface dry degree of the subject to be dried is greater than or equal to the second threshold value, the processor 130 may control the hot air supplying device 124 to operate as much as the dry time corresponding to bedding, and if the acquired moving distance is smaller than the first threshold value and the acquired surface dry degree of the subject to be dried is smaller than the second threshold value, the processor 130 may control the hot air supplying device 124 to operate as much as the dry time corresponding to clothing.

Here, the processor 130 may additionally consider the surface dry degree other than the moving distance. The surface dry degree may be determined based on the surface voltage received from the sensing device 200. The sensing device 200 may include a contact-type electrode sensor, and acquire a surface voltage. Here, the surface voltage may mean a voltage sensed at the surface of the sensing device 200, and depending on whether the sensing device 200 contacts the subject to be dried, the sensed surface voltage may be different. In general, if there is moisture in the contacting part, the surface voltage may be sensed to be low.

The processor 130 may analyze the surface voltage received from the sensing device 200 at a predetermined time, and acquire the surface dry degree. Then, if the surface dry degree is greater than or equal to the second threshold value, the processor 130 may identify that the subject to be dried is bedding, and if the surface dry degree is smaller than the second threshold value, the processor 130 may identify that the subject to be dried is clothing. Bedding has a bigger volume than clothing. Accordingly, the time necessary for drying the entire bedding is greater than the time necessary for drying the entire clothing. However, when considering only the surface, the surface of the bedding may be dried faster. This is because bedding includes a light cotton material, and while the volume is big, the weight or the density is low. Accordingly, the processor 130 may acquire the surface dry degree at the predetermined time and compare the surface dry degree with the second threshold value, and if the surface dry degree is greater than or equal to the second threshold value, the processor 130 may identify that the subject to be dried is bedding. Here, the predetermined time may be changed according to the user's setting. The predetermined time may be the time when the predetermined time passed after the dry process started. However, here, the predetermined time may be 10 minutes to within 30 minutes. This is because the surface dry degree may become close to the maximum value for both of clothing and bedding in case too much time passed. Accordingly, the user may determine in advance the time when the dry degree of the surface of bedding and the dry degree of the surface of clothing are different, and use the time as the predetermined time.

The operation of identifying clothing or identifying bedding based on the moving distance may not be an operation that should necessarily be performed. Depending on implementation examples, the processor 130 may not go through the operation of determining (identifying) clothing/bedding, but determine the dry time based on the acquired moving distance, first threshold value, surface dry degree, and second threshold value.

Meanwhile, the processor 130 may perform additionally dry during a first time for operating as much as the dry time corresponding to clothing, and the processor 130 may perform additional dry during a second time longer than the first time for operating as much as the dry time corresponding to bedding.

Here, the first time may be 0 hour. If the subject to be dried is identified as clothing, the processor 130 may not grant (or allot) a separate additional time. However, if the subject to be dried is identified as bedding, the processor 130 may grant (or allot) an additional time to the dry process for perfect dry.

The processor 130 may identify the type of the subject to be dried at the predetermined time, and determine whether to grant an additional time. As bedding has a big volume unlike clothing, a longer dry time may be needed. Also, a case wherein dry of the inner surface is not completed even though dry of the outer surface was completed may occur. Accordingly, if the subject to be dried is identified as bedding, the processor 130 may additionally perform the dry process as much as an additional time other than the basic time.

Meanwhile, the processor 130 may acquire the moving pattern information of the sensing device 200 based on the first voltage value, and if it is identified that a specific moving pattern is repeated based on the acquired moving pattern information, the processor 130 may control the hot air supplying device 124 to operate as much as the dry time corresponding to clothing, and if it is identified that the moving pattern is irregular based on the acquired moving pattern information, the processor 130 may control the hot air supplying device 124 to operate as much as the dry time corresponding to bedding.

As an example of acquiring the moving pattern information of the sensing device 200 based on the first voltage value, the moving pattern information may be acquired by the sensing device 200, and the processor 130 may acquire the moving pattern information from the sensing device 200.

As another example, the processor 130 may acquire the first voltage from the sensing device 200, and acquire the movement amount information corresponding to the sensing device 200 based on the acquired first voltage. Then, the processor 130 may analyze the acquired movement amount information, and acquire (or analyze) the moving pattern.

The moving pattern may be information indicating in which pattern the sensing device 200 is moving. For example, while general clothing is drying, the sensing device 200 may rise and descend (or fall) in a vertical direction according to the rotation of the drum 122. Also, as the rotation of the drum 122 occurs repeatedly, the rising and descending pattern may be identified repeatedly. However, while bedding is drying, the sensing device 200 may irregularly rise and descend in spite of the rotation of the drum 122. This is because, as the volume of the bedding is big, the movement of the sensing device 200 may be restrictive.

Meanwhile, the processor 130 may acquire the second voltage value from the sensing device 200, and while the hot air supplying device 124 is controlled, the processor 130 may calculate the number of times that the second voltage value is smaller than the third threshold value during a threshold time based on the current time, and acquire the surface dry degree information of the subject to be dried based on the calculated number of times.

Here, the processor 130 may acquire the surface voltage value from the sensing device 200, and identify whether the acquired surface voltage value is smaller than the third threshold value. Then, the processor 130 may calculate the number of times that the surface voltage value is smaller than the third threshold value during the threshold time (e.g., 30 seconds) based on the current time. The feature that the surface voltage value is identified to be low may mean that the humidity is high or there is moisture. Accordingly, the processor 130 may determine the surface dry degree based on the number of times that the surface voltage value is smaller than the third threshold value. As the calculated number of times is more during the threshold time, the processor 130 may identify that the dry degree is lower. Here, the processor 130 may set the standard for the surface dry degree as the third threshold value, and calculate the number of times that the surface voltage value is smaller than the third threshold value during the threshold time.

Meanwhile, if the acquired moving distance is greater than or equal to the first threshold value, the processor 130 may control the hot air supplying device 124 to operate as much as the dry time corresponding to clothing, and if the acquired moving distance is smaller than the first threshold value and the calculated number of times is greater than or equal to the threshold number of times, the processor 130 may control the hot air supplying device 124 to operate as much as the dry time corresponding to clothing, and if the acquired moving distance is smaller than the first threshold value and the calculated number of times is smaller than the threshold number of times, the processor 130 may control the hot air supplying device 124 to operate as much as the dry time corresponding to bedding.

The processor 130 may calculate the number of times that the surface voltage value is smaller than the third threshold value during the threshold time, and classify the type of the subject to be dried depending on whether the calculated number of times is greater than or equal to the threshold number of times. As the calculated number of times is more, it may mean that there is more moist on the surface of the subject to be dried, and the dry degree is low. Accordingly, if the calculated number of times is greater than or equal to the threshold number of times, the processor 130 may determine that the subject to be dried has moisture, and that the subject to be dried is clothing.

The operation of identifying clothing or bedding may not be an operation that should necessarily be performed. The processor 130 may not go through the operation of determining (identifying) clothing/bedding, but determine the dry time based on the calculated number of times and the threshold number of times.

Meanwhile, the processor 130 may control the dry apparatus 100 based on the setting information corresponding to the voltage (the first voltage value), and the setting information corresponding to the voltage (the first voltage value) may include at least one of the dry time, the dry temperature, the strength of the hot air, or the rotating speed of the drum 122.

Here, the operation of controlling the dry apparatus 100 may mean all control operations necessary for a dry process such as an operation of rotating the drum 122 or an operation of operating the hot air supplying device 124, etc. for performing a dry process.

The aforementioned threshold value, threshold time, and threshold number of times may be values that were determined by a user in advance. Also, the aforementioned values may vary according to times. For example, as in the graphs disclosed in FIG. 7 to FIG. 9, the values of sensing data may vary according to time, and thus the threshold value, the threshold time, and the threshold number of times for analyzing sensing data may also vary according to measurement times.

As an example, sensing data may be measured after a predetermined time from the time when the dry process starts (e.g., 30 minutes). This is because, in the case of determining the surface dry degree after about 30 minutes passed, the dry degree may clearly vary according to the type of the subject to be dried. In the case of using only the movement amount of the sensing device 200 but not the surface dry degree, the predetermined time may be shorter (e.g., 30 seconds).

As another example, sensing data may be measured in case a predetermined event occurred. For example, the predetermined event may be an event wherein the internal humidity (acquired by the dry apparatus 100 by itself) is determined to be smaller than the threshold humidity or an event wherein the dry process is completed.

Meanwhile, the dry apparatus 100 according to an embodiment of the disclosure may determine the characteristic information of the subject to be dried based on the movement amount of the sensing device 200. Accordingly, the dry apparatus 100 may automatically perform a dry process appropriate for the subject to be dried even if the user does not directly input the characteristic of the subject to be dried. Accordingly, the dry apparatus 100 can provide high convenience to the user.

Meanwhile, the dry apparatus 100 according to an embodiment of the disclosure may acquire the surface dry degree of the subject to be dried by using the surface voltage value. When the surface dry degree is considered other than the movement amount, the material or other characteristics of the subject to be dried may be determined clearly. This is because, even if the dry process is performed for the same time and at the same temperature, the surface dry degree of the subject to be dried is partially different according to the material. Accordingly, the dry apparatus 100 may clearly analyze various subjects to be dried, and provide appropriate dry methods. Accordingly, the dry apparatus 100 may apply an appropriate dry method such that the subject to be dried is not damaged according to a high temperature.

Meanwhile, in the above, only simple components constituting the dry apparatus 100 were illustrated and described, but in actual implementation, various components may additionally be provided. Explanation in this regard will be made below with reference to FIG. 23.

Figure 23:
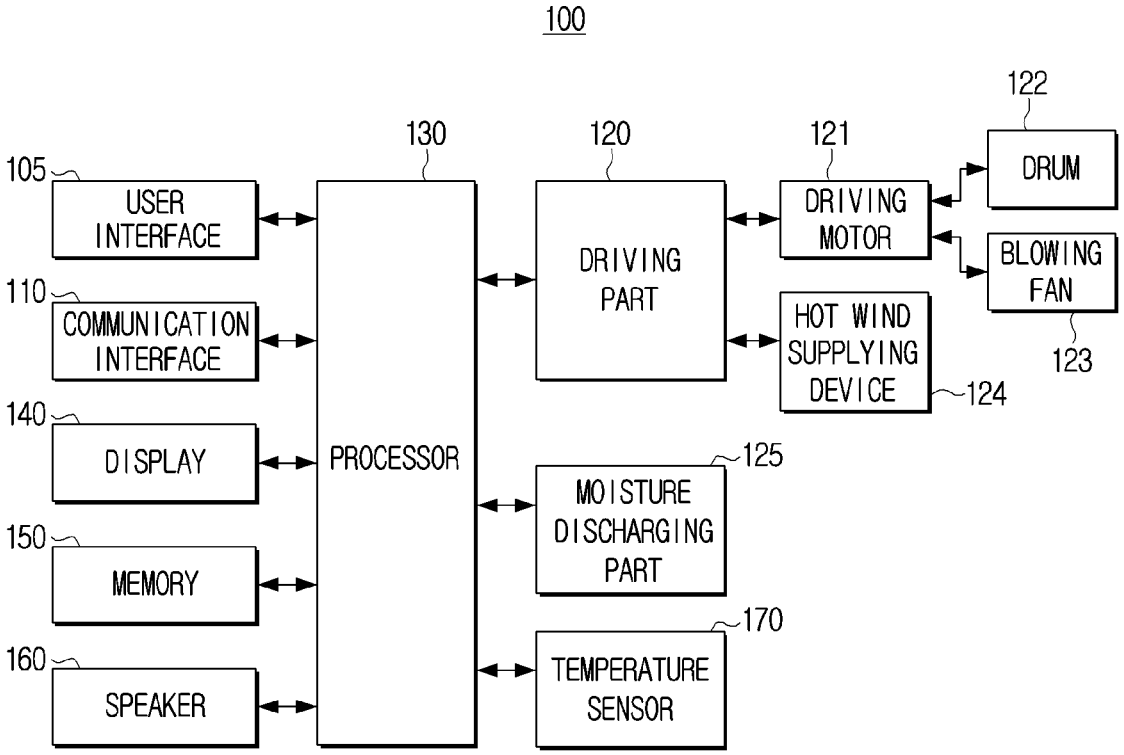
FIG. 23 is a block diagram for illustrating a detailed configuration of a dry apparatus according to various embodiments of the disclosure.

FIG. 23 is a block diagram for illustrating a detailed configuration of a dry apparatus according to various embodiments of the disclosure.

Referring to FIG. 23, the dry apparatus 100 may include a user interface 105, a communication interface 110, a driving part 120, a driving motor 121, a drum 122, a blowing fan 123, a hot air supplying device 124, a moisture discharging part 125, a processor 130, a display 140, a memory 150, a speaker 160, and a temperature sensor 170.

Meanwhile, among the operations of the communication interface 110 and the processor 130, regarding the same operations as the operations described above, overlapping explanation will be omitted.

The driving part 120 may drive the driving motor 121 based on a driving control signal generated by the processor 130.

The driving motor 121 may receive power and generate a driving force, and the driving motor 121 may transmit the generated driving force to the drum 122 and the blowing fan 123.

The drum 122 may mean a dry tub accommodating the subject to be dried. The drum 122 may be rotated by the driving force generated from the driving motor 121.

The blowing fan 123 may mean a fan that circulates air of a high temperature supplied to the drum of the dry apparatus 100. Specifically, the blowing fan 123 may receive a driving control signal generated by the processor 130, and rotate to circulate the air inside the drum to which a heat source was supplied.

The driving part 120 may receive the driving control signal generated by the processor 130, and drive the hot air supplying device 124 such that it can supply a heat source to the drum.

The hot air supplying device 124 may supply a heat source to the drum 122.

The hot air supplying device 124 may be implemented by a gas type heat source supplying method or an electricity type heat source supplying method. The gas type method may mean a method of heating air by using gas. The electricity type method may mean a method of heating air by using electricity. The electricity type method may be a method of using at least one of a hot air supplying device or a heat pump. The hot air supplying device may use a method of supplying a heat source by using a heat wire, etc. The heat pump may use a method of supplying a heat source by using a refrigerant. The heat pump may include an evaporator, a compressor, and a condenser. Specifically, the evaporator may evaporate a refrigerant in a liquid state to a gaseous state. Then, the refrigerant in a gaseous state may be transmitted to the compressor. The compressor may compress the refrigerant in a state of a high temperature and high pressure. Then, the compressed refrigerant may be transmitted to the condenser. The condenser may perform a heat-exchanging operation from the compressed refrigerant and take heat, and heat the air with the taken heat and discharge the air. Here, the discharged air of a hot temperature may be supplied to the drum 122 of the dry apparatus 100. The refrigerant from which heat was taken by the condenser may be transmitted to the evaporator and circulated.

The moisture discharging part 125 may discharge moisture inside the dry apparatus 100. The dry apparatus 100 may be a vent type (a hot air discharging method) or a condensing type (a hot air dehumidifying method) according to the method of discharging moisture. The vent type method may be a method of discharging moisture and dust to the outside of the dry apparatus 100. The condensing type method may be a method of filtering dust through a filter and making moisture pass through a condenser (a heat exchanger), and converting the moisture into condensed water. The condensed water may be discharged to the outside of the dry apparatus 100 or stored in an inner tub of the dry apparatus 100.

The display 140 may be implemented as displays in various forms such as a liquid crystal display (LCD), an organic light emitting diodes (OLED) display, a plasma display panel (PDP), etc. Inside the display 140, driving circuits that may be implemented in forms such as an a-si TFT, a low temperature poly silicon (LTPS) TFT, an organic TFT (OTFT), etc., a backlight unit, etc. may also be included. Meanwhile, the display 140 may be implemented as a touch screen combined with a touch sensor, a flexible display, a three-dimensional display (a 3D display), etc.

Also, the display 140 according to an embodiment of the disclosure may include not only a display panel outputting images, but also a bezel housing the display panel. In particular, the bezel according to an embodiment of the disclosure may include a touch sensor (not shown) for detecting user interactions.

The memory 150 may be implemented as an internal memory such as a ROM (e.g., an electrically erasable programmable read-only memory (EEPROM)), a RAM, etc. included in the processor 130, or implemented as a separate memory from the processor 130. In this case, the memory 150 may be implemented in a form of a memory embedded in the dry apparatus 100, or in a form of a memory that can be attached to or detached form the dry apparatus 100 according to the use of stored data. For example, in the case of data for an operation of the dry apparatus 100, the data may be stored in a memory embedded in the dry apparatus 100, and in the case of data for an extended function of the dry apparatus 100, it may be stored in a memory that can be attached to or detached from the dry apparatus 100.

Meanwhile, in the case of a memory embedded in the dry apparatus 100, it may be implemented as at least one of a volatile memory (e.g.: a dynamic RAM (DRAM), a static RAM (SRAM), or a synchronous dynamic RAM (SDRAM), etc.) or a non-volatile memory (e.g.: a one time programmable ROM (OTPROM), a programmable ROM (PROM), an erasable and programmable ROM (EPROM), an electrically erasable and programmable ROM (EEPROM), a mask ROM, a flash ROM, a flash memory (e.g.: a NAND flash or a NOR flash, etc.), a hard drive, or a solid state drive (SSD)). Meanwhile, in the case of a memory that can be attached to or detached from the dry apparatus 100, it may be implemented as forms such as a memory card (e.g., a compact flash (CF), a secure digital (SD), a micro secure digital (Micro-SD), a mini secure digital (Mini-SD), an extreme digital (xD), a multi-media card (MMC), etc.), an external memory that can be connected to a USB port (e.g., a USB memory), and the like.

The speaker 160 may be a component that outputs not only various kinds of audio data processed at an input/output interface, but also various kinds of notification sounds or voice messages, etc.

The temperature sensor 170 may sense the temperature inside the dry apparatus 100. The temperature sensor 170 may include at least one of a first temperature sensor sensing the temperature of the air of the drum 122 inside the dry apparatus 100 or a second temperature sensor sensing the temperature of the refrigerant inside the dry apparatus 100. The temperature data sensed by the temperature sensor 170 may be transmitted to the processor 130, and the processor 130 may control the operation of the dry apparatus 100 based on the sensed temperature data.

Meanwhile, the methods according to the various embodiments of the disclosure as described above may be implemented in forms of applications that can be installed on conventional dry apparatuses.

Also, the methods according to the various embodiments of the disclosure as described above may be implemented just with software upgrade, or hardware upgrade of conventional dry apparatuses.

In addition, the methods according to the various embodiments of the disclosure as described above may be performed through an embedded server provided on a dry apparatus, or an external server of at least one of a dry apparatus or a display apparatus.

Meanwhile, according to an embodiment of the disclosure, the aforementioned various embodiments may be implemented as software including instructions stored in machine-readable storage media, which can be read by machines (e.g.: computers). The machines refer to devices that call instructions stored in a storage medium, and can operate according to the called instructions, and the devices may include a dry apparatus according to the aforementioned embodiments. In case an instruction is executed by a processor, the processor may perform a function corresponding to the instruction by itself, or by using other components under its control. An instruction may include a code that is generated or executed by a compiler or an interpreter. A storage medium that is readable by machines may be provided in the form of a non-transitory storage medium. Here, the term 'non-transitory' only means that a storage medium does not include signals, and is tangible, but does not indicate whether data is stored in the storage medium semi-permanently or temporarily.

Also, according to an embodiment of the disclosure, methods according to the aforementioned various embodiments may be provided while being included in a computer program product. The computer program product can be traded between a seller and a purchaser as a commodity. The computer program product may be distributed in the form of a machine-readable storage medium (e.g.: a compact disc read only memory (CD-ROM)), or distributed online through an application store (e.g.: PLAY STORE™). In the case of online distribution, at least a portion of the computer program product may be at least temporarily stored in a storage medium such as a server of a manufacturer, a server of an application store, or a memory of a relay server, or temporarily generated.

Further, each of the components according to the aforementioned various embodiments (e.g.: a module or a program) may include a singular object or a plurality of objects. Also, among the aforementioned corresponding sub components, some sub components may be omitted, or other sub components may be further included in the various embodiments. Alternatively or additionally, some components (e.g.: a module or a program) may be integrated as an object, and perform the functions that were performed by each of the components before integration identically or in a similar manner. A module, a program, or operations performed by other components according to the various embodiments may be executed sequentially, in parallel, repetitively, or heuristically. Or, at least some of the operations may be executed in a different order or omitted, or other operations may be added.

So far, preferred embodiments of the disclosure have been shown and described, but the disclosure is not limited to the aforementioned specific embodiments, and it is apparent that various modifications may be made by those having ordinary skill in the technical field to which the disclosure belongs, without departing from the gist of the disclosure as claimed by the appended claims. Also, it is intended that such modifications are not to be interpreted independently from the technical idea or prospect of the disclosure.

Although the present disclosure has been described with various embodiments, various changes and modifications may be suggested to one skilled in the art. It is intended that the present disclosure encompass such changes and modifications as fall within the scope of the appended claims.

What is claimed is:

1. A dryer comprising:

a communication interface;

a display;

a drum accommodating a subject to be dried;

a sensing device configured to construct a wireless communication link with the communication interface by using power generated through self-power generation according to a rotation of the drum;

a hot air supplying device configured to supply hot air to the drum; and a processor configured to:

based on constructing the wireless communication link between the sensing device and the communication interface by the sensing device using power generated through self-power generation according to the rotation of the drum to connect to the dryer, display a first object indicating that the sensing device has generated power and has been connected to the dryer on the display.

2. The dryer of claim 1, wherein the first object includes at least one of an icon, a text, or an image for indicating that the sensing device has been connected.

3. The dryer of claim 1, wherein the processor is configured to:

control the communication interface to receive sensing data from the sensing device, and while receiving the sensing data, control the display to display a second object for indicating that the subject to be dried is detected based on the sensing data.

4. The dryer of claim 3, wherein the processor is configured to:

control a rotating operation of the drum, and based on receiving the sensing data during a first threshold time from a time when the drum was started to rotate, control the display to display the second object during a second threshold time smaller than the first threshold time.

5. The dryer of claim 3, further comprising:

a speaker, and wherein the processor is configured to:

output a predetermined alarm sound through the speaker at a time when the second object is displayed.

6. The dryer of claim 1, wherein the processor is configured to:

detect the subject to be dried based on sensing data acquired from the sensing device, and control the display to display a third object for indicating the detected subject to be dried.

7. The dryer of claim 1, wherein the processor is configured to:

control the display to display a fourth object for indicating a dry course corresponding to the subject to be dried detected based on sensing data acquired from the sensing device.

8. The dryer of claim 1, wherein the processor is configured to:

determine an operation time of the hot air supplying device based on sensing data acquired from the sensing device, based on the hot air supplying device operating after the determined operation time, control the display to display a fifth object for indicating an additional operation of the hot air supplying device, and based on completing the operation of the hot air supplying device, control the display to display a sixth object for indicating that the operation of the hot air supplying device is completed.

9. The dryer of claim 1, wherein the processor is configured to:

determine an operation time of the hot air supplying device based on sensing data acquired from the sensing device, and based on completing an operation of the hot air supplying device before the determined operation time, control the display to display a seventh object for indicating a difference between the determined operation time and an operation completion time of the hot air supplying device.

10. The dryer of claim 1, wherein the processor is configured to:

based on receiving a user input for inspecting the sensing device, control the display to display an eighth object for guiding a predetermined user action, acquire a change value of sensing data acquired from the sensing device that was acquired during a specific time from a time when the eight object was displayed, based on the change value of the sensing data being smaller than a threshold value, control the display to display a ninth object for indicating a breakage of the sensing device, and based on the change value of the sensing data being greater than or equal to the threshold value, control the display to display a tenth object for indicating that the sensing device is normal.

11. A controlling method of a dryer, the method comprising:

receiving a signal for initiating an operation of the dryer;

based on receiving the signal for initiating the operation, controlling a drum that is provided in the dryer and accommodates a subject to be dried to rotate, and controlling a hot air supplying device provided in the dryer to supply hot air to the drum;

receiving identification information from a sensing device that harvests power from rotating in the drum through a communication interface provided in the dryer; and based on receiving the identification information, displaying a first object indicating that the sensing device has generated power and has been connected to the dryer by the sensing device using power generated through self-power generation according to the rotation of the drum to connect to the dryer on a display provided in the dryer.

12. The controlling method of claim 11, wherein the first object includes at least one of an icon, a text, or an image for indicating that the sensing device has been connected.

13. The controlling method of claim 11, further comprising:

receiving sensing data from the sensing device; and while receiving the sensing data, displaying a second object for indicating that the subject to be dried is detected based on the sensing data.

14. The controlling method of claim 13, further comprising:

controlling a rotating operation of the drum; and wherein the displaying the second object comprises:

based on receiving the sensing data during a first threshold time from a time when the drum started to rotate, displaying the second object during a second threshold time smaller than the first threshold time.

15. The controlling method of claim 13, further comprising:

outputting a predetermined alarm sound through a speaker at a time when the second object is displayed.

16. The controlling method of claim 11, further comprising:

detecting the subject to be dried based on sensing data acquired from the sensing device, and controlling the display to display a third object for indicating the detected subject to be dried.

17. The controlling method of claim 11, further comprising:

controlling the display to display a fourth object for indicating a dry course corresponding to the subject to be dried detected based on sensing data acquired from the sensing device.

18. The controlling method of claim 11, further comprising:

determining an operation time of the hot air supplying device based on sensing data acquired from the sensing device, based on the hot air supplying device operating after the determined operation time, controlling the display to display a fifth object for indicating an additional operation of the hot air supplying device, and based on completing an operation of the hot air supplying device, controlling the display to display a sixth object for indicating that the operation of the hot air supplying device is completed.

19. The controlling method of claim 11, further comprising:

determining an operation time of the hot air supplying device based on sensing data acquired from the sensing device, and based on completing the operation of the hot air supplying device before the determined operation time, controlling the display to display a seventh object for indicating a difference between the determined operation time and an operation completion time of the hot air supplying device.

20. The controlling method of claim 11, further comprising:

based on receiving a user input for inspecting the sensing device, controlling the display to display an eighth object for guiding a predetermined user action, acquiring a change value of sensing data acquired from the sensing device that was acquired during a specific time from a time when the eight object was displayed, based on the change value of the sensing data being smaller than a threshold value, controlling the display to display a ninth object for indicating a breakage of the sensing device, and based on the change value of the sensing data being greater than or equal to the threshold value, controlling the display to display a tenth object for indicating that the sensing device is normal.

* * * * *